US010605150B2

(12) United States Patent
Toyama et al.

(10) Patent No.: US 10,605,150 B2
(45) Date of Patent: Mar. 31, 2020

(54) COOLING DEVICE FOR INTERNAL COMBUSTION ENGINE OF VEHICLE AND CONTROL METHOD THEREOF

(71) Applicant: HITACHI AUTOMOTIVE SYSTEMS, LTD., Hitachinaka-shi, Ibaraki (JP)

(72) Inventors: Yuichi Toyama, Isesaki (JP); Atsushi Murai, Isesaki (JP); Shigeyuki Sakaguchi, Isesaki (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/761,178

(22) PCT Filed: Jan. 5, 2017

(86) PCT No.: PCT/JP2017/000132

§ 371 (c)(1),
(2) Date: Mar. 19, 2018

(87) PCT Pub. No.: WO2017/119445

PCT Pub. Date: Jul. 13, 2017

(65) Prior Publication Data

US 2018/0266304 A1 Sep. 20, 2018

(30) Foreign Application Priority Data

Jan. 6, 2016 (JP) ..... 2016-001233

(51) Int. Cl.
*F01P 7/04* (2006.01)
*F01P 7/16* (2006.01)
(Continued)

(52) U.S. Cl.
CPC ..... *F01P 7/04* (2013.01); *F01P 3/02* (2013.01); *F01P 7/048* (2013.01); *F01P 7/16* (2013.01);
(Continued)

(58) Field of Classification Search
CPC ..... F01P 3/02; F01P 3/20; F01P 2003/024; F01P 5/10; F01P 7/04; F01P 7/048;
(Continued)

(56) References Cited

U.S. PATENT DOCUMENTS 6,668,764 B1 * 12/2003 Henderson ..... F01P 7/167 123/41.1
8,443,775 B2 * 5/2013 Ktami ..... F01P 7/165 123/142.5 E
(Continued)

FOREIGN PATENT DOCUMENTS

DE 26 31 121 A1 1/1978
DE 11 2014 006 486 10/2017
(Continued)

OTHER PUBLICATIONS

Notice of Allowance in U.S. Appl. No. 15/759,918 dated Mar. 20, 2019 (8 pages including PTO/SB/08 forms).
(Continued)

*Primary Examiner* — John M Zaleskas
(74) *Attorney, Agent, or Firm* — Foley & Lardner LLP

(57) ABSTRACT

The present invention provides a cooling device for an internal combustion engine of a vehicle. While the vehicle is in a decelerating state and while the internal combustion engine is in an idle reduction state, the cooling device increases the ratio of the cooling water circulation rate through a first path which extends through a heater core and a radiator while reducing the ratio of the cooling water circulation rate through a second path which bypasses the heater core and radiator. In addition, the cooling device increases the discharge flow rate of the electric water pump while the vehicle is in a decelerating state, and maintains the electric water pump in an operating state during idle reduction. Thus, the present invention allows accelerating the temperature decrease of the cylinder head during idle reduc-
(Continued)

tion, as well as improving fuel economy during acceleration when the vehicle is started.

5 Claims, 15 Drawing Sheets

(51) Int. Cl.

| | |
|---|---|
| ***F02D 17/00*** | (2006.01) |
| ***F01P 3/02*** | (2006.01) |
| *F02D 41/04* | (2006.01) |
| *F01P 5/10* | (2006.01) |
| *F02P 5/15* | (2006.01) |
| *F02N 11/08* | (2006.01) |
| *F02P 5/152* | (2006.01) |

(52) U.S. Cl.
CPC ..... *F01P 7/164* (2013.01); *F02D 17/00* (2013.01); *F01P 2003/028* (2013.01); *F01P 2005/105* (2013.01); *F01P 2060/04* (2013.01); *F01P 2060/08* (2013.01); *F01P 2060/16* (2013.01); *F02D 41/042* (2013.01); *F02N 11/0814* (2013.01); *F02P 5/152* (2013.01); *F02P 5/1508* (2013.01)

(58) Field of Classification Search
CPC ..... F01P 7/14; F01P 7/16; F01P 7/164; F01P 7/165; F01P 2007/146; F01P 2025/40; F01P 2025/64; F01P 2025/66
USPC ..... 123/41.02, 41.08, 41.09, 41.44
See application file for complete search history.

(56) References Cited

U.S. PATENT DOCUMENTS

| | | | | |
|---|---|---|---|---|
| 8,958,933 | B2 * | 2/2015 | Abihana | B60W 10/06 701/22 |
| 9,816,429 | B2 | 11/2017 | Murai et al. | |
| 2004/0103862 | A1 * | 6/2004 | Aidnik | F01P 7/164 123/41.29 |
| 2006/0231640 | A1 * | 10/2006 | Hashimura | B60H 1/00492 237/34 |
| 2010/0236502 | A1 * | 9/2010 | Watanabe | B60K 6/48 123/41.02 |
| 2011/0214627 | A1 * | 9/2011 | Nishikawa | F01P 7/04 123/41.02 |
| 2013/0255603 | A1 * | 10/2013 | Pursifull | F01P 11/16 123/41.15 |
| 2013/0255605 | A1 * | 10/2013 | Jentz | F01P 11/16 123/41.15 |
| 2013/0284127 | A1 * | 10/2013 | Goto | F01P 11/16 123/41.02 |
| 2014/0007824 | A1 * | 1/2014 | Hayashi | F01P 7/167 123/41.01 |
| 2014/0103847 | A1 * | 4/2014 | Kawamoto | F01P 7/048 318/471 |
| 2014/0283765 | A1 * | 9/2014 | Naito | F01P 3/12 123/41.09 |
| 2015/0377114 | A1 * | 12/2015 | Matsumoto | F02F 1/14 123/41.44 |
| 2016/0010533 | A1 * | 1/2016 | Matsumoto | F01P 3/02 123/41.08 |
| 2017/0002719 | A1 * | 1/2017 | Dudar | F01P 1/06 |
| 2017/0074153 | A1 * | 3/2017 | Kaneko | F01P 7/165 |
| 2017/0096930 | A1 * | 4/2017 | Murai | F01P 3/02 |
| 2017/0107891 | A1 * | 4/2017 | Murai | F01P 3/02 |
| 2017/0253104 | A1 * | 9/2017 | Amano | F01P 3/18 |
| 2017/0254255 | A1 * | 9/2017 | Murai | F01P 3/20 |
| 2017/0292435 | A1 * | 10/2017 | Toyama | F01P 11/16 |
| 2018/0038267 | A1 * | 2/2018 | Murai | F01P 7/16 |
| 2018/0080366 | A1 * | 3/2018 | Toyama | B60H 1/08 |
| 2018/0245503 | A1 * | 8/2018 | Toyama | F01P 3/20 |
| 2018/0245504 | A1 * | 8/2018 | Murai | F01P 7/16 |
| 2018/0266304 | A1 * | 9/2018 | Toyama | F01P 7/04 |

FOREIGN PATENT DOCUMENTS

| | | | | |
|---|---|---|---|---|
| JP | 2006-125274 | A | 5/2006 | |
| JP | 2006-161745 | A | 6/2006 | |
| JP | 2006161745 | A * | 6/2006 | |
| JP | 2009-068363 | A | 4/2009 | |
| JP | 2011-122559 | A | 6/2011 | |
| JP | 2011-179460 | A | 9/2011 | |
| JP | 2012-197706 | A | 10/2012 | |
| JP | 2015-172355 | A | 10/2015 | |
| JP | 2015-178787 | A | 10/2015 | |
| JP | 2015-178824 | A | 10/2015 | |
| WO | WO 2014192747 | A1 * | 12/2014 | F01P 7/167 |

OTHER PUBLICATIONS

German Office Action dated Oct. 23, 2018 as issued in corresponding German Application No. 11 2016 003 821.6 and its partial English translation thereof.
Japanese Office Action dated Dec. 18, 2018 as issued in corresponding Japanese Application No. 2016-001233 and its partial English translation thereof.
Japanese Office Action dated May 22, 2018 as issued in corresponding Japanese Application No. 2015-246108 and its partial English translation thereof.
Toyama: Non-Final Office Action on U.S. Appl. No. 15/759,918 dated Nov. 1, 2018.
German Office Action dated Jan. 22, 2019 in corresponding German Application No. 112017000301.6 with partial English translation thereof.

* cited by examiner

COOLING DEVICE FOR INTERNAL COMBUSTION ENGINE OF VEHICLE AND CONTROL METHOD THEREOF

TECHNICAL FIELD

The present invention relates to a cooling device for an internal combustion engine of a vehicle, a control device and a flow rate control valve for use therein, and to a method for controlling the cooling device, and specifically relates to a cooling technique for improving fuel economy when the vehicle is started from an automatic stop state of the internal combustion engine which is assumed when the vehicle stops.

BACKGROUND ART

Patent Document 1 discloses a cooling device including an electric water pump for circulating cooling water. During the second period after the engine is stopped, the cooling device maintains the electric water pump in an operating state and controls the control valve such that only the cooling water circulation through the cylinder head is permitted. Thereby, the cooling device prevents pre-ignition from occurring at the start-up of the engine.

REFERENCE DOCUMENT LIST

Patent Document

Patent Document 1 JP 2009-068363 A

SUMMARY OF THE INVENTION

Problem to be Solved by the Invention

A vehicle may have an idle reduction function to automatically stop the internal combustion engine when the vehicle stops. In such a vehicle, if the cylinder head temperature can be reduced during idle reduction, the retarded degree of ignition timing required for avoiding knocking at the subsequent vehicle restart is allowed to be reduced, and fuel economy will be improved. However, when the time from the activation of idle reduction to the vehicle restart is short, the cooling control for reducing the cylinder head temperature is performed only for a short period during the idle reduction. In such a case, the cooling control may possibly fail to sufficiently lower the cylinder head temperature, which reduces the improvement in fuel economy.

In view of the above, an object of the present invention is to provide a cooling device for an internal combustion engine of a vehicle, a control device and a flow rate control valve for use therein, and a method for controlling the cooling device, which are capable of accelerating the temperature decrease of the cylinder head during idle reduction, as well as improving fuel economy during acceleration when the vehicle is started from an automatic stop state as much as possible.

Means for Solving the Problem

To this end, the cooling device for an internal combustion engine of a vehicle according to the present invention comprises: a cooling water circulation passage including: a first cooling water line which extends through a cylinder head of the internal combustion engine and through a radiator, and in which water flows outside of a cylinder block of the internal combustion engine; a second cooling water line which extends through the cylinder block, and in which water flows outside of the radiator; a third cooling water line which extends through the cylinder head and heater core, and bypasses the cylinder block and the radiator; and a fourth cooling water line which extends through the cylinder head and a heat exchanger for a powertrain of the internal combustion engine; an electric water pump for circulating cooling water through the cooling water circulation passage; and switching means for switching between a plurality of modes including: an all-path flow mode for opening all the first to fourth cooling water lines; and an automatic stop mode for reducing opening areas of the second and fourth cooling water lines as compared to in the all-path flow mode. The cooling device increases a discharge flow rate of the electric water pump while the vehicle is in a decelerating state, and maintains the electric water pump in an operating state while the internal combustion engine is in an automatic stop state which is assumed when the vehicle stops after the decelerating state. The cooling device causes the switching means to switch to the automatic stop mode during the decelerating state and the automatic stop state.

Effects of the Invention

According to the invention as described above, while the internal combustion engine is in an automatic stop state when the vehicle stops, the electric water pump is maintained in an operating state. Thus, the internal combustion engine is maintained cooled during the automatic stop state to allow restarting of the internal combustion engine with a reduced temperature. Furthermore, as early as a decelerating state toward the automatic stop, the discharge flow rate of the electric water pump is increased, and thus, the cooling water circulation rate through the cooling water circulation passage is increased. This further accelerates the temperature decrease of the internal combustion engine during the automatic stop. Accordingly, the present invention allows the internal combustion engine to restart from the automatic stop state with a temperature reduced as much as possible. Therefore, the present invention can reduce the retarded degree of ignition timing required for avoiding knocking during acceleration when the vehicle is started, and improving fuel economy.

MODES FOR CARRYING OUT THE INVENTION

Figure 1:
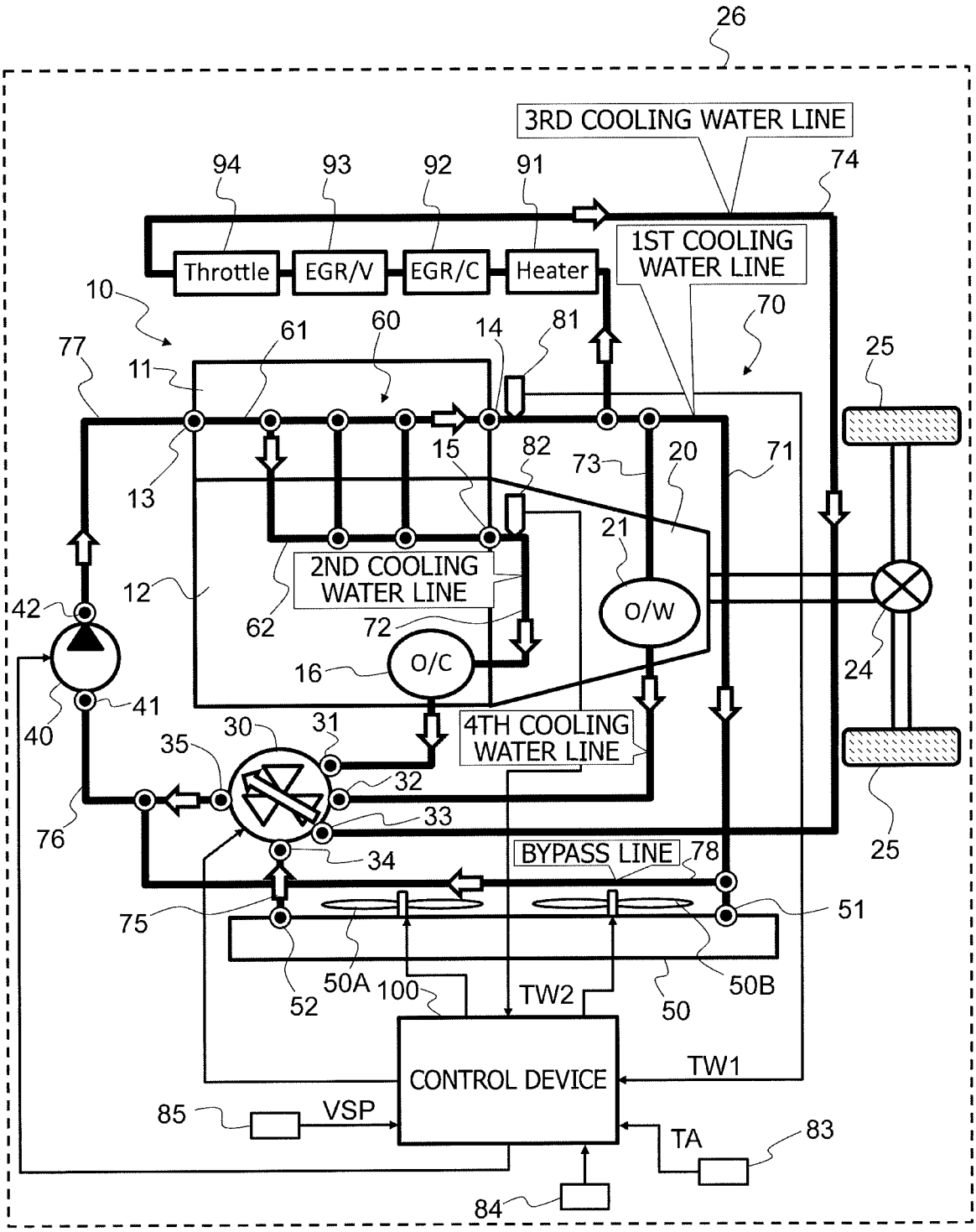
FIG. 1 is a schematic system view of the cooling device for an internal combustion engine according to an embodiment of the present invention.

An embodiment of the present invention will be described below. FIG. 1 is a configuration diagram illustrating an example of a cooling device for the internal combustion engine of the vehicle according to the present invention. The term "cooling water" herein encompasses various coolants used in cooling devices for an internal combustion engine of a vehicle, such as Engine antifreeze coolants standardized under Japanese Industrial Standard K 2234.

An internal combustion engine 10 is installed in a vehicle 26 and used as a power source to drive vehicle 26. A transmission 20 such as a continuously variable transmission (CVT), an example of the powertrain, is coupled to the output shaft of internal combustion engine 10. The output of transmission 20 is transmitted to drive wheels 25 of vehicle 26 via a differential gear 24.

Internal combustion engine 10 is cooled by a water-based cooling device which circulates cooling water through a circulation passage. The cooling device includes a flow rate control valve 30, which serves as a switching means, an electric water pump 40, a radiator 50 including electric radiator fans 50A, 50B, a cooling water passage 60 provided in internal combustion engine 10, an oil cooler 16 for internal combustion engine 10, a heater core 91, an oil warmer 21 for transmission 20, pipes 70 connecting these components, and the like. Oil cooler 16 is a heat exchanger for internal combustion engine oil. Oil warmer 21 is a heat exchanger for transmission oil.

Internal combustion engine 10 has a cylinder head cooling water passage 61 and a cylinder block cooling water passage 62, which collectively serve as cooling water passage 60 in internal combustion engine 10. Cylinder head cooling water passage 61, which functions to cool a cylinder head 11, extends in cylinder head 11 so as to connect a cooling water inlet 13 to a cooling water outlet 14 which are provided to cylinder head 11. In cylinder head 11, cooling water inlet 13 is provided at one end in the cylinder arrangement direction, and cooling water outlet 14 is provided at the other end in the cylinder arrangement direction.

Cylinder block cooling water passage 62, which functions to cool a cylinder block 12, branches off from cylinder head cooling water passage 61 and enters cylinder block 12. Cylinder block cooling water passage 62 extends in cylinder block 12 and is connected to a cooling water outlet 15 provided to cylinder block 12. Cooling water outlet 15 of cylinder block cooling water passage 62 is provided at an end, on the same side where cooling water outlet 14 of cylinder head cooling water passage 61 is provided, in the cylinder arrangement direction.

In this cooling device exemplified in FIG. 1, the cooling water is supplied through cylinder head 11 to cylinder block 12. The cooling water supplied to cylinder head 11 circulates through at least either path of: a circulation path through which the cooling water flows bypassing cylinder block 12 and is discharged from cooling water outlet 14; and a circulation path through which the cooling water enters cylinder block 12 and is then discharged from cooling water outlet 15. To cooling water outlet 14 of cylinder head 11, one end of a first cooling water pipe 71 is connected. The other end of first cooling water pipe 71 is connected to a cooling water inlet 51 of radiator 50.

To cooling water outlet 15 of cylinder block cooling water passage 62, one end of a second cooling water pipe 72 is connected. The other end of second cooling water pipe 72 is connected to a first inlet port 31 among four inlet ports 31 to 34 of flow rate control valve 30. At a certain point of second cooling water pipe 72, oil cooler 16 for cooling lubricating oil for internal combustion engine 10 is disposed. Oil cooler 16 is a heat exchanger for cooling the lubricating oil for internal combustion engine 10 by exchanging heat between the cooling water flowing through second cooling water pipe 72 and the lubricating oil.

One end of a third cooling water pipe 73 is connected to first cooling water pipe 71. The other end of third cooling water pipe 73 is connected to second inlet port 32 of flow rate control valve 30. At a certain point of third cooling water pipe 73, oil warmer 21 is disposed as a heat exchanger for adjusting the temperature of hydraulic oil in transmission 20, which is a hydraulic mechanism. Oil warmer 21 exchanges heat between the cooling water flowing through third cooling water pipe 73 and the hydraulic oil in transmission 20. In other words, third cooling water pipe 73 allows the cooling water having increased in temperature while flowing through cylinder head 11 to be partially diverted and introduced into oil warmer 21. Oil warmer 21 accelerates the temperature rise in the hydraulic oil in transmission 20 during cold engine start, and then maintains the hydraulic oil temperature in transmission 20 around its proper temperature by avoiding an excessive rise in the oil temperature.

One end of a fourth cooling water pipe 74 is connected a to first cooling water pipe 71 at a point between cooling water outlet 14 and the junction of first and third cooling water pipes 71, 73. The other end of fourth cooling water pipe 74 is connected to third inlet port 33 of flow rate control valve 30. Various heat exchanging devices are disposed on fourth cooling water pipe 74. The heat exchanging devices disposed on fourth cooling water pipe 74 are, in the order from upstream to downstream, heater core 91 for vehicle air heating, a water-based EGR (exhaust gas recirculation) cooler 92, an EGR control valve 93, and a throttle valve 94. EGR cooler 92 and EGR control valve 93 constitute an EGR device of internal combustion engine 10. Throttle valve 94 regulates the rate of air intake into internal combustion engine 10.

Heater core 91, which is a heat exchanger for heating air for air-conditioning included in a vehicle air conditioner, exchanges heat between the cooling water flowing through fourth cooling water pipe 74 and the air for air-conditioning so as to heat the air for air-conditioning. EGR cooler 92, which is a heat exchanger for cooling recirculated exhaust, exchanges heat between the cooling water flowing through fourth cooling water pipe 74 and the exhaust recirculated into the intake system of internal combustion engine 10 by the EGR device so as to lower the temperature of the exhaust recirculated into the intake system of internal combustion engine 10.

EGR control valve 93 for regulating the exhaust recirculation rate and throttle valve 94 for regulating the rate of air intake into internal combustion engine 10 are heated by exchanging heat with the cooling water flowing through fourth cooling water pipe 74. Heating EGR control valve 93 and throttle valve 94 with the cooling water prevents the freezing of moisture in the exhaust around EGR control valve 93 as well as moisture in the intake air around throttle valve 94.

As described above, fourth cooling water pipe 74 allows the cooling water having passed through cylinder head 11 to be partially diverted and introduced into heater core 91, EGR cooler 92, EGR control valve 93, and throttle valve 94 so as to exchange heat therewith. One end of a fifth cooling water pipe 75 is connected to a cooling water outlet 52 of radiator 50. The other end of fifth cooling water pipe 75 is connected to fourth inlet port 34 of flow rate control valve 30.

Flow rate control valve 30 has a single outlet port 35. One end of a sixth cooling water pipe 76 is connected to outlet port 35. The other end of sixth cooling water pipe 76 is connected to an intake port 41 of electric water pump 40. One end of a seventh cooling water pipe 77 is connected to a discharge port 42 of electric water pump 40. The other end of seventh cooling water pipe 77 is connected to cooling water inlet 13 of cylinder head 11.

One end of an eighth cooling water pipe 78 is connected to first cooling water pipe 71. The other end of eighth cooling water pipe 78 is connected to sixth cooling water pipe 76. Specifically, in first cooling water pipe 71, the point where eighth cooling water pipe 78 is connected is located downstream to the point connected to third cooling water pipe 73 and downstream to the point connected to fourth cooling water pipe 74. As described above, flow rate control valve 30 has four inlet ports 31 to 34 and one outlet port 35. Cooling water pipes 72, 73, 74, 75 are respectively connected to inlet ports 31, 32, 33, 34, and sixth cooling water pipe 76 is connected to outlet port 35.

Flow rate control valve 30 is a rotational flow channel switching valve that includes a stator having ports formed therein, and a rotor which has flow channels formed therein and is fitted in the stator. When flow rate control valve 30 is actuated by the electric actuator such as an electric motor, the electric actuator rotates the rotor, thereby changing the angle of the rotor relative to the stator. In rotational flow rate control valve 30 as described above, the opening area ratio of four inlet ports 31 to 34 changes depending on the rotor angle. The ports in the stator and the flow channels in the rotor are adapted such that a desirable opening area ratio, in other words, a desirable flow rate ratio among the cooling water lines may be achieved through selection of the rotor angle.

In the cooling device with the above configuration, cylinder head cooling water passage 61, first cooling water pipe 71, radiator 50, and fifth cooling water pipe 75 constitute a first cooling water line through which the cooling water circulates by way of cylinder head 11 and radiator 50, and bypasses cylinder block 12. As used herein, the first cooling water line may also be referred to as a radiator line. Cylinder block cooling water passage 62, second cooling water pipe 72, and oil cooler 16 constitute a second cooling water line through which the cooling water circulates by way of cylinder block 12 and oil cooler 16, and bypasses radiator 50. As used herein, the second cooling water line may also be referred to as a block line.

Cylinder head cooling water passage 61, fourth cooling water pipe 74, heater core 91, EGR cooler 92, EGR control valve 93, and throttle valve 94 constitute a third cooling water line through which the cooling water circulates by way of cylinder head 11 and heater core 91, and bypasses radiator 50. As used herein, the third cooling water line may also be referred to as a heater line. Cylinder head cooling water passage 61, third cooling water pipe 73, and oil warmer 21 constitute a fourth cooling water line through which the cooling water circulates by way of cylinder head 11 and oil warmer 21, and bypasses radiator 50. As used herein, the fourth cooling water line may also be referred to as a powertrain system line or a CVT line.

In addition, eighth cooling water pipe 78 allows the cooling water flowing from cylinder head 11 to radiator 50 through the first cooling water line to be partially diverted to flow through eighth cooling water pipe 78. The diverted flow of cooling water bypasses radiator 50, and enters a point downstream to the outlet of flow rate control valve 30. In other words, even when inlet ports 31 to 34 of flow rate control valve 30 are closed, eighth cooling water pipe 78 allows the cooling water having passed through cylinder head cooling water passage 61 to circulate bypassing radiator 50. In this way, eighth cooling water pipe 78 constitutes a bypass line. The cooling water circulation passage according to this embodiment includes the first to fourth cooling water lines and the bypass line.

As described above, the inlet ports of flow rate control valve 30 are connected respectively to the outlets of the first to fourth cooling water lines, and the outlet port of flow rate control valve 30 is connected to the intake port of electric water pump 40. Flow rate control valve 30 is a switching means for controlling the supply rates of the cooling water respectively to the first to fourth cooling water lines, in other words, for controlling the cooling water allocation ratio between the first to fourth cooling water lines, by regulating the opening areas of the respective outlets of the first to fourth cooling water lines.

Electric water pump 40 and flow rate control valve 30 described above are controlled by a control device 100, which serves as a control means. Control device 100 includes a microcomputer, i.e., a processor, including a CPU, a ROM, a RAM, and the like. Control device 100 receives measurement signals from various sensors for sensing operational conditions of internal combustion engine 10.

The above various sensors include a first temperature sensor 81, a second temperature sensor 82, an external air temperature sensor 83, and a vehicle speed sensor 85. First temperature sensor 81 measures the temperature of the cooling water in first cooling water pipe 71 near cooling water outlet 14, i.e., a cooling water temperature TW1 near the outlet of cylinder head 11. Second temperature sensor 82 measures the temperature of the cooling water in second cooling water pipe 72 near cooling water outlet 15, i.e., a cooling water temperature TW2 near the outlet of cylinder block 12. External air temperature sensor 83 measures an external air temperature TA. Vehicle speed sensor 85 measures a travelling speed VSP of vehicle 26. In the cooling device, second temperature sensor 82 may be omitted, and the cooling device may include only first temperature sensor 81 as a sensor for measuring cooling water temperature.

In addition, control device 100 receives a signal from an engine switch 84 for turning on and off internal combustion engine 10. In response, control device 100 controls the rotor angle of flow rate control valve 30, the rotation speed of electric water pump 40, the driving voltage of electric radiator fans 50A, 50B, and the like, in accordance with operational conditions of internal combustion engine 10.

Below, an implementation of cooling control performed by control device 100 while internal combustion engine 10 is operating will be described. Flow rate control valve 30 is configured to allocate cooling water among the cooling water lines based on the allocation ratio selected from those associated with multiple modes. Control device 100 controls flow rate control valve 30 and the rotation speed, i.e., discharge flow rate of electric water pump 40 in one of these modes that is selected according to operational conditions of internal combustion engine 10.

Figure 2:
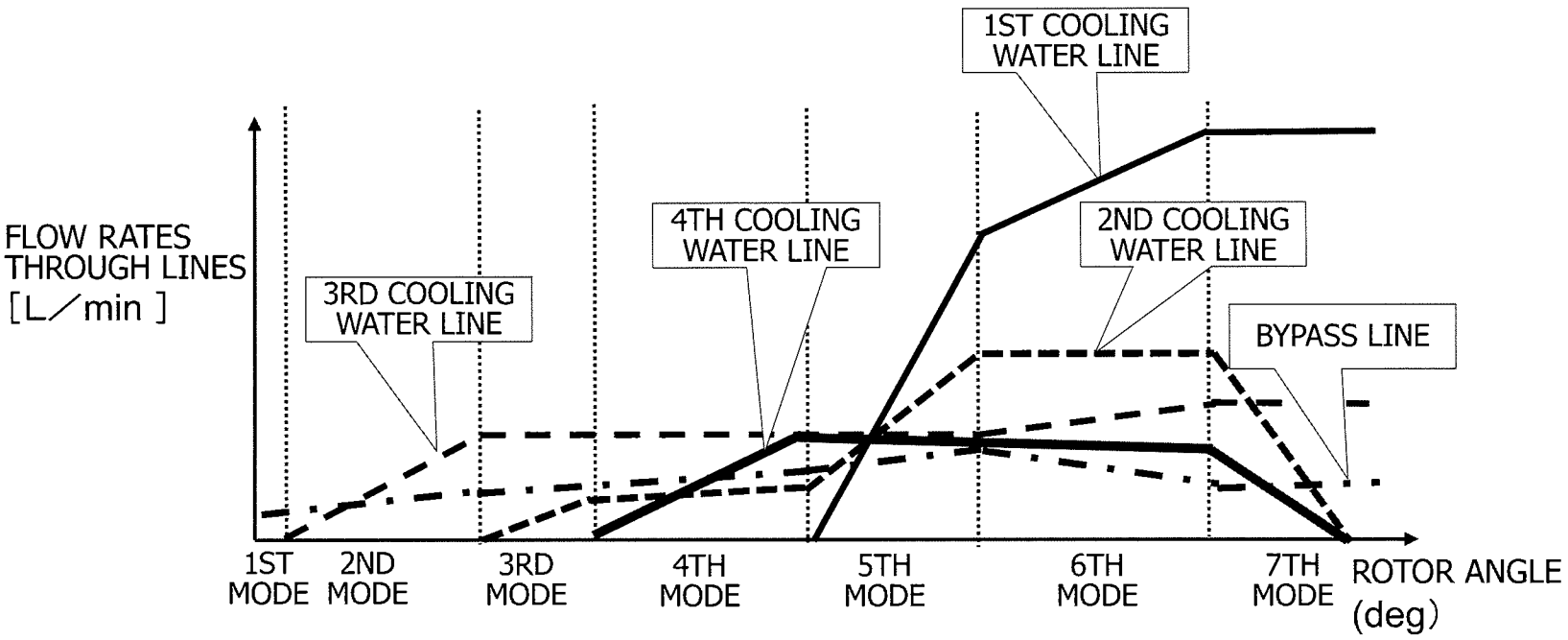
FIG. 2 is a graph illustrating the correlation between the rotor angle and modes of the flow rate control valve according to the embodiment of the present invention.

FIG. 2 exemplifies the correlation between the rotor angle of flow rate control valve 30 and the expected flow rates of the cooling water lines in each mode, given that the cooling water flow rates are also affected by the rotation speed control of electric water pump 40. At cold engine start, control device 100 controls flow rate control valve 30 such that its rotor angle falls within a predetermined angular range from a reference angular position at which the rotor is positionally regulated by a stopper. Thereby, flow rate control valve 30 enters a first mode in which all inlet ports 31 to 34 are closed.

In this first mode, at which all inlet ports 31 to 34 are closed, electric water pump 40 circulates the cooling water only through the bypass line. In other words, at cold engine start, control device 100 controls flow rate control valve 30 according to the first mode, so that cooling water circulates through cylinder head 11, bypassing the other heat exchange devices such as radiator 50.

Additionally, in this first mode, control device 100 causes electric water pump 40 to operate at a sufficiently low rotation speed so as to minimize the circulation rate of cooling water. This allows for detection of the temperature rise of cylinder head 11 based on the rise in the cooling water temperature and also allows for quick warm-up of cylinder head 11. Note that the state in which flow rate control valve 30 closes all inlet ports 31 to 34 in the first mode includes not only the condition in which the opening area of each of inlet ports 31 to 34 is zero, but also the conditions in which the opening area of each of inlet ports 31 to 34 is reduced to the minimum value which permits a small leak of the cooling water. Note also that the rotor angle used herein indicates a rotation angle from the reference angular position at which the rotor is positionally regulated by the stopper.

When the rotor angle of flow rate control valve 30 is increased to greater than the angular range for the first mode, flow rate control valve 30 is switched to a second mode. In the second mode, third inlet port 33 connected to the outlet of the third cooling water line is opened while the other inlet ports 31, 32, 34 are maintained closed. By switching from the first mode to the second mode after the temperature of cylinder head 11 reaches a predetermined temperature, control device 100 increases the flow rate of cooling water circulating through heater core 91. As a result, the air heating function works more effectively at the startup.

In accordance with a rise in the block outlet water temperature, control device 100 further increases the rotor angle beyond the angular range of the second mode so as to switch flow rate control valve 30 to a third mode. In the third mode, in addition to third inlet port 33 connected to the outlet of the third cooling water line, first inlet port 31 connected to the outlet of the second cooling water line is also opened. The third mode aims to cool cylinder block 12 as well as the oil in internal combustion engine 10. When the block outlet water temperature reaches a target temperature, control device 100 further increases the rotor angle beyond the angular range of the third mode so as to switch flow rate control valve 30 to a fourth mode. In the fourth mode, in addition to third inlet port 33 connected to the outlet of the third cooling water line and first inlet port 31 connected to the outlet of the second cooling water line, second inlet port 32 connected to the outlet of the fourth cooling water line is also opened. The fourth mode aims to warm the oil in transmission 20 and thus reduce friction in transmission 20. When second temperature sensor 82 is omitted from the cooling device, control device 100 controls switching to the third mode and further to the fourth mode in accordance, for example, with the measurement of the engine oil temperature.

When the warming-up of internal combustion engine 10 is completed through the above process, control device 100 opens the first cooling water line in addition to the second to fourth cooling water lines in accordance with the water temperature rise so as to maintain the cylinder head temperature and cylinder block temperature at their respective target temperatures. In other words, control device 100 adjusts the flow rate of cooling water circulating through radiator 50 by switching flow rate control valve 30 to a fifth mode. Further, when the water temperature rises above the target temperature for the fifth mode, control device 100 further increases the rotor angle beyond the angular range of the fifth mode. Thereby, control device 100 performs fail-safe processing to switch flow rate control valve 30 to a sixth mode, which allows maximizing the ratio of cooling water circulation through the first cooling water line.

In addition to controlling the rotor angle of flow rate control valve 30 in accordance with the rise in the water temperature, control device 100 also controls the discharge flow rate of electric water pump 40 in accordance with the difference between the target water temperature and the actual water temperature. During engine warm-up, control device 100 accelerates the warm-up by limiting the discharge flow rate to a low level. After the completion of the engine warm-up, control device 100 increases the discharge flow rate when the water temperature exceeds the target temperature so as to maintain the water temperature around the target temperature. The first to sixth modes are control modes of flow rate control valve 30 applied while internal combustion engine 10 is operating. In addition to first to sixth modes, there is a seventh mode for accelerating the temperature decrease of cylinder head 11 during the period in which internal combustion engine 10 is automatically stopped by the idle reduction function. The seventh mode is also referred to herein as an automatic stop mode. In order to accelerate the temperature decrease of cylinder head 11 during idle reduction, control device 100 controls flow rate control valve 30 according to the seventh mode.

The idle reduction function of internal combustion engine 10 is a function of: automatically stopping internal combustion engine 10 when a predetermined idle reduction condition is satisfied when vehicle 26 stops in order, for example, to wait for a traffic light to change; and restarting internal combustion engine 10 automatically in response to a "vehicle start" request or the like. Control device 100 may have an idle reduction control function for stopping idling of internal combustion engine 10. Alternatively, a different control device may have such an idle reduction control function. In such a case, control device 100 performs control according to the seventh mode upon receiving a signal indicating that internal combustion engine 10 is in idle reduction from this different control device.

As illustrated in FIG. 2, the seventh mode is associated with an angular range beyond the angular range of the sixth mode. As the rotor angle increases within the angular range of the seventh mode, the second and fourth cooling water lines are narrowed in opening area, and finally closed off. Thus, as the rotor angle increases in the seventh mode, the ratio of the cooling water circulation rate through the first and third cooling water lines relatively increases. Note that the closed-off state of a cooling water line includes the conditions in which cooling water flows through the cooling water line at a minimum leak flow rate. Here, the first cooling water line constitutes a first path which extends through cylinder head cooling water passage 61 and through radiator 50 or heater core 91. The second and fourth cooling water lines constitute a second path which extends through the oil heat exchangers, i.e., oil cooler 16 and oil warmer 21, and bypasses radiator 50. Thus, the seventh mode corresponds to a mode for reducing the cooling water flow through the second path while increasing the cooling water flow through the first path.

Each of the fifth and sixth modes is an all-path flow mode for allowing the cooling water to flow through all the first to fourth cooling water lines. Thus, by switching from the fifth or sixth mode to the seventh mode, control device 100 reduces the cooling water circulation rate through oil cooler 16 and oil warmer 21 while increasing the cooling water circulation rate through cylinder head cooling water passage 61, and then radiator 50 or heater core 91.

While vehicle 26 is decelerating toward the idle reduction state, control device 100 increases the discharge flow rate of electric water pump 40 and controls the rotor angle of flow rate control valve 30 according to the seventh mode. While vehicle 26 stops after such deceleration and internal combustion engine 10 is automatically stopped by the idle reduction function, control device 100 maintains electric water pump 40 in an operating state and controls the rotor angle of flow rate control valve 30 according to the seventh mode.

The cooling control performed by control device 100 as described above accelerates the temperature decrease of cylinder head 11 during idle reduction. This allows a reduction of the retarded degree of ignition timing required for avoiding knocking during acceleration when the vehicle is started from the idle reduction state, and improves fuel economy during acceleration when the vehicle is started from such an automatic stop state. Here, in the seventh mode, the ratio of the cooling water circulation rate through heater core 91 increases. Thus, since control device 100 sets flow rate control valve 30 to the seventh mode during idle reduction, the deterioration of the vehicle air heating performance during idle reduction is suppressed.

Figure 3:
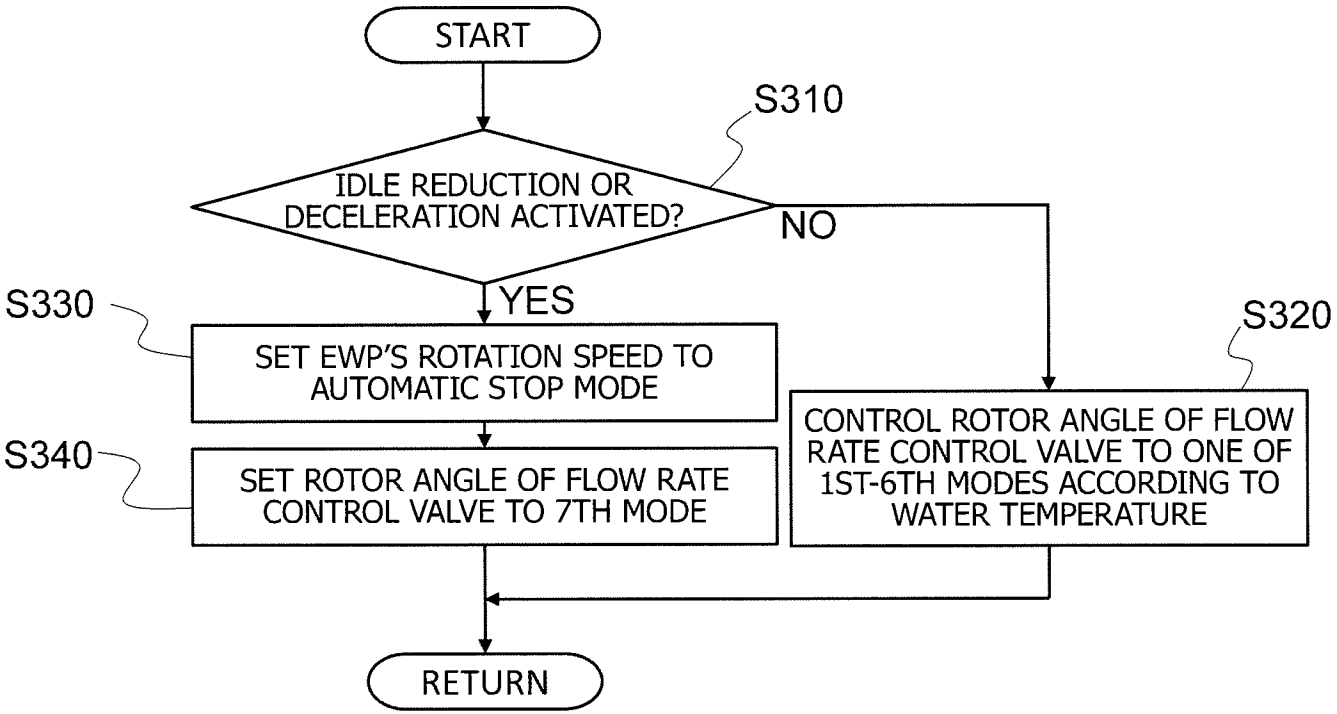
FIG. 3 is a flowchart illustrating the flow of controlling the flow rate control valve and electric water pump according to the embodiment of the present invention.

The cooling control performed by control device 100 during idle reduction will be described in detail below. The flowchart of FIG. 3 illustrates a main routine of the control of electric water pump 40 and flow control valve 30 performed by control device 100. The main routine illustrated in the flowchart of FIG. 3 is interruptedly executed by control device 100 at predetermined time intervals.

In step S310, first, control device 100 determines whether or not vehicle 26 is in a predetermined decelerating state, or whether or not internal combustion engine 10 is in an idle reduction state. When vehicle 26 is not in the predetermined decelerating state and internal combustion engine 10 is not in an idle reduction state, the operation proceeds to step S320. In step S320, control device 100 selects any one of the first to sixth modes in accordance with the measurement value of the water temperature, and controls electric water pump 40 and flow rate control valve 30 according to the selected mode.

Here, the "predetermined decelerating state" refers to the state in which vehicle 26 has decelerated enough to potentially causes internal combustion engine 10 to reach an automatic stop state activated by the idle reduction function. In step S310, based on the operational status of vehicle 26 and/or internal combustion engine 10, control device 100 determines whether or not vehicle 26 is in the predetermined decelerating state. For example, control device 100 may determine that vehicle 26 is in the predetermined decelerating state when the following conditions are satisfied:

(1) Internal combustion engine 10 is in a deceleration fuel cut-off state.
(2) The vehicle speed is equal to or below a predetermined value.
(3) The brake of vehicle 26 is activated.
(4) The rotation speed of internal combustion engine 10 decreases at a rate equal to or above a predetermined value.
(5) Internal combustion engine 10 rotates at a speed equal to or below a predetermined value.
(6) The degree of acceleration decreases at a rate equal to or above a predetermined value.
(7) The degree of acceleration is equal to or below a predetermined value.
(8) The drive assist system has decided to decelerate vehicle 26; specifically, the drive assist system has recognized a standing vehicle or a stop sign ahead, for example.

Note that the conditions for determining the predetermined decelerating state are not limited to the above conditions (1) to (8). Furthermore, control device 100 may determine that vehicle 26 is in the predetermined decelerating state when one or more of the above conditions (1) to (8) are satisfied. Moreover, when vehicle 26 is determined to be continuously in the predetermined decelerating state for a duration equal to or above a predetermined time, control device 100 may cancel the deceleration determination and perform the normal control in step S320.

When control device 100 determines that vehicle 26 is in the predetermined decelerating state, the operation proceeds to step S330. Also, when control device 100 determines that internal combustion engine 10 is in an idle reduction state, the operation proceeds to step S330. In other words, control device 100 performs the cooling control according to the automatic stop mode as early as when vehicle 26 is in a decelerating state toward an idle reduction state in addition to during idle reduction. This further accelerates the temperature decrease of cylinder head 11 during the idle reduction.

In step S330, control device 100 sets the target rotation speed of electric water pump 40 to a target rotation speed for the automatic stop mode. The target rotation speed (target rotation speed>0 rpm) for the automatic stop mode is set to a higher rotation speed as the head outlet water temperature is higher than a target water temperature for the idle reduction state. By variably setting the target rotation speed for the automatic stop mode in this manner, control device 100 increases the rotation speed of electric water pump 40 while vehicle 26 is in a decelerating state.

Figure 4:
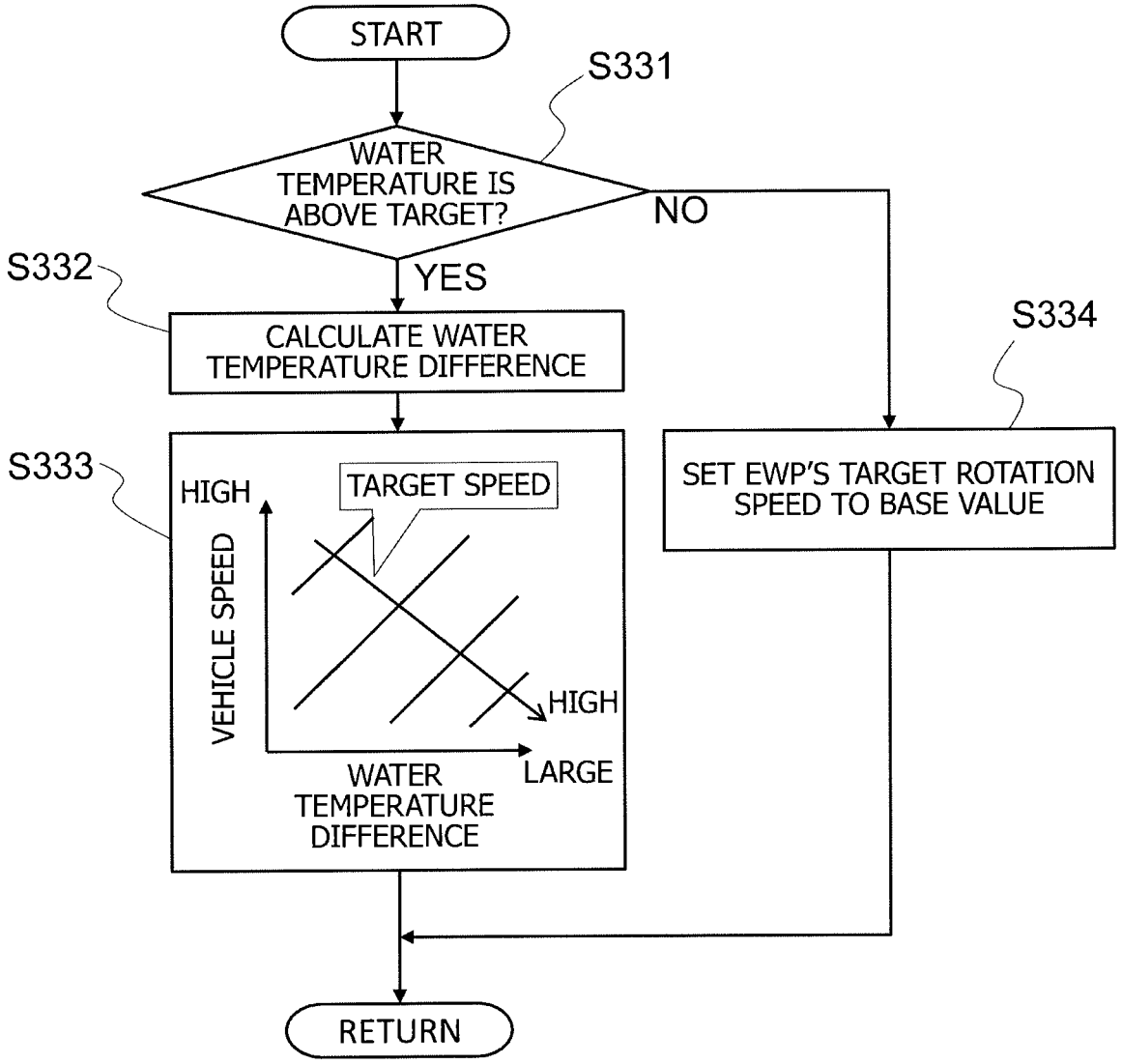
FIG. 4 is a flowchart illustrating control for setting the target rotation speed of the electric water pump according to the embodiment of the present invention.

The target rotation speed for the automatic stop mode is set to a rotation speed above 0 rpm regardless of the water temperature condition. As a result, electric water pump 40 is maintained in an operating state during idle reduction. An example of processing for setting the target rotation speed in step S330 will be described with reference to the flowchart of FIG. 4.

In step S331, control device 100 determines whether or not the head outlet water temperature is above the target temperature for the idle reduction state. Here, the target temperature for the idle reduction state is below the target temperature for while internal combustion engine 10 is in an operating state. When the head outlet water temperature is above the target temperature for the idle reduction state, the operation proceeds to step S332.

In step S332, control device 100 calculates the difference TWDC between the current head outlet water temperature and the target temperature for the idle reduction state (TWDC=head outlet water temperature−target temperature).

Then, the operation proceeds to step S333, in which control device 100 variably sets the target rotation speed of electric water pump 40 based on the vehicle speed and water temperature difference TWDC. Specifically, in step S333, control device 100 sets the target rotation speed of electric water pump 40 such that the lower the vehicle speed, the higher the target rotation speed, and that the higher the head outlet water temperature above the target temperature for the idle reduction state, the higher the target rotation speed.

When the vehicle speed is high, a strong wind generated by the vehicle movement enhances the heat radiation efficiency of radiator 50. Thus, a sufficient heat radiation is ensured even when the cooling water circulation rate is reduced along with an increase in the vehicle speed. Therefore, control device 100 sets the target rotation speed such that the higher the vehicle speed, the lower the target rotation speed. Moreover, if the cooling water circulation rate is fixed, the higher the head outlet water temperature above the target temperature for the idle reduction state, the longer it takes to reduce the head outlet water temperature to the target temperature. Therefore, control device 100 sets the target rotation speed of electric water pump 40 such that the higher the head outlet water temperature above the target temperature for the idle reduction state, the higher the target rotation speed, thereby quickly reducing the cylinder head temperature to the target temperature.

Here, when the vehicle speed is 0 km/h during idle reduction, the higher the water temperature difference TWDC, the higher is the target rotation speed set. This allows control device 100 not only to accelerate the temperature decrease of cylinder head 11 during idle reduction by maintaining electric water pump 40 in an operating state so as to keep the cooling water circulating during the idle reduction, but also to further accelerate the decrease of the head outlet water temperature during the idle reduction by increasing the rotation speed of electric water pump 40 as early as a decelerating state toward the idle reduction state so as to prepare for the idle reduction.

During idle reduction, when the head outlet water temperature has decreased to the target temperature for the idle reduction state, the operation proceeds to step S334. In step S334, control device 100 fixes the target rotation speed of electric water pump 40 to a base rotation speed (base rotation speed>0 rpm) for during idle reduction. The base rotation speed may be the minimum value in the range within which the target rotation speed is variably set in step S333.

In step S330, control device 100 variably sets the target pump rotation speed based on the water temperature difference TWDC and vehicle speed. Alternatively, in place of or in combination with the water temperature difference TWDC and/or vehicle speed, one or more different condition variables may be used in variably setting the target rotation speed. As long as affecting the performance of cooling cylinder head 11, various parameters may be used as condition variables for variably setting the target pump rotation speed for the automatic stop mode.

For example, control device 100 varies the target pump rotation speed depending on the external air temperature, the difference between the external air temperature and head outlet water temperature, the rotor angle of flow rate control valve 30, operational conditions of internal combustion engine 10 before switching to the idle reduction mode, and/or the like. The operational conditions of internal combustion engine 10 include the engine load, the engine rotation speed, for example. The higher the external air temperature, the less easily is the temperature of cylinder head 11 reduced. Accordingly, control device 100 may be programmed to vary the target pump rotation speed for the automatic stop mode such that the higher the external air temperature, the higher the target pump rotation speed.

Similarly, the less the difference between the external air temperature and head outlet water temperature, the less easily is the cylinder head temperature reduced. Accordingly, control device 100 may be programmed to vary the target pump rotation speed for the automatic stop mode such that the greater the difference between the external air temperature and head outlet water temperature, the higher the target pump rotation speed. Furthermore, the temperature of cylinder head 11 can be reduced less easily during a transitional state within the seventh mode, i.e., while the rotor angle of flow rate control valve 30 has entered the angular range of the seventh mode, but has not yet reached the angle at which the second and fourth cooling water lines become closed. This is because, in such a transitional state, cooling water is still supplied to the second and fourth cooling water lines, each of which bypasses radiator 50.

Accordingly, control device 100 may be programmed to vary the target pump rotation speed for the automatic stop mode such that the greater the difference between the actual rotor angle of flow rate control valve 30 and the rotor angle at which the second and fourth cooling water lines become closed, the higher the target pump rotation speed for the automatic stop mode. Also, when the operational conditions of internal combustion engine 10 before switching to the automatic stop mode involve a large amount of heat generation, the cylinder head temperature can be less easily reduced during idle reduction. Accordingly, control device 100 may be programmed to increase the target pump rotation speed for the automatic stop mode when, for example, internal combustion engine 10 operates at higher load and rotation speed for a long time before switching to the automatic stop mode.

After control device 100 sets the target rotation speed of electric water pump 40 for the automatic stop mode in a manner as described above in step S330 of the flowchart of FIG. 3, the operation proceeds to step S340. In step S340, control device 100 sets the target rotor angle of flow rate control valve 30 within the angular range of the seventh mode, which is adapted to the idle reduction state.

In other words, as early as the decelerating state toward the idle reduction state, control device 100 starts to control the rotor angle of flow rate control valve 30 so as to fall within the angular range of the seventh mode, which is the automatic stop mode. In addition, control device 100 maintains the rotor angle of flow rate control valve 30 within the angular range of the automatic stop mode during idle reduction. Within the angular range of the automatic stop mode, the supply rate of the cooling water to the second path, which extends through the oil heat exchangers, i.e., oil cooler 16 and oil warmer 21, and bypasses radiator 50, is reduced while the supply rate of the cooling water to the first path, which extends through cylinder head cooling water passage 61 and radiator 50 or heater core 91, which are located downstream to cylinder head cooling water passage 61, is increased.

Thus, the cooling water flow control according to the automatic stop mode allows more efficient cooling of cylinder head 11 than when the cooling water flows through all the paths, thus accelerating the temperature decrease of cylinder head 11 during idle reduction. Furthermore, the cooling water flow control according to the automatic stop mode starts as early as the decelerating state toward the idle reduction state. This further accelerates the temperature decrease of cylinder head 11 during idle reduction. Here, in the control according to the automatic stop mode, control device 100 may maintain the target rotor angle of flow rate control valve 30 within the seventh mode. However, control device 100 does not have to maintain the target rotor angle within the seventh mode. Control device 100 may switch between the modes in accordance with the need for oil cooling or the like.

Figure 5:
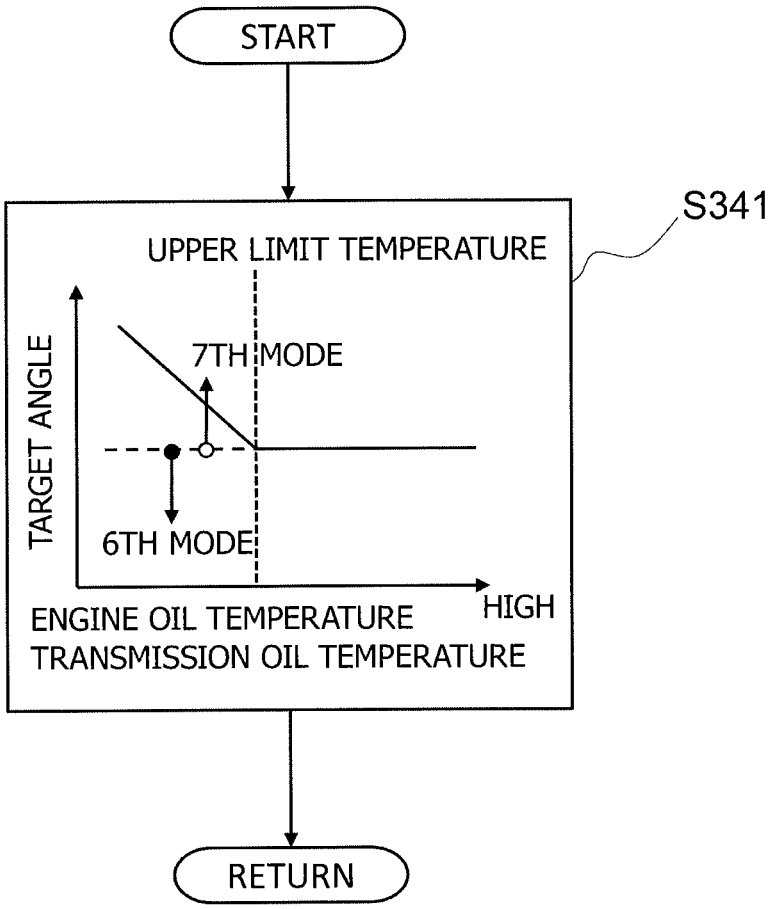
FIG. 5 is a flowchart illustrating control of the flow rate control valve performed in accordance with the oil temperatures during idle reduction according to the embodiment of the present invention.

The flowchart of FIG. 5 illustrates, as an example of processing for setting the rotor angle of flow rate control valve 30 in the step S340, processing for mode switching in accordance with the need for oil cooling. In step S341, control device 100 sets the target rotor angle of flow rate control valve 30 for the automatic stop mode depending on the temperatures of the oil in internal combustion engine 10 and/or the oil in transmission 20.

The control apparatus 100 can perform this oil temperature-based mode switching depending on either one of the oil temperature of internal combustion engine 10 and the oil temperature of transmission 20 that is selected as a representative oil temperature. For example, control device 100 may select, as the representative oil temperature, whichever is the higher of the oil temperatures of internal combustion engine 10 and transmission 20. Alternatively, control device 100 may calculate the difference between the actual and standard values of the oil temperature of internal combustion engine 10 as well as the difference between the actual and standard values of the oil temperature of transmission 20, and select, as the representative oil temperature, whichever has a greater difference from its standard value of the two.

As another alternative, control device 100 may calculate the degree of engine oil cooling need based on the oil temperature of internal combustion engine 10 as well as the degree of transmission oil cooling need based on the oil temperature of transmission 20, and switches between the modes depending on whichever oil cooling has the higher degree of need. As yet another alternative, control device 100 may switch between the modes depending, for example, on the average of the oil temperatures of internal combustion engine 10 and transmission 20.

In the seventh mode, control device 100 closes the second and fourth cooling water lines to stop the cooling water circulation through oil cooler 16 and oil warmer 21. However, even in the seventh mode, when the temperatures of the lubricating oil in internal combustion engine 10 and/or the hydraulic oil in transmission 20 are above their upper limit temperatures and need to be reduced, it is necessary to circulate cooling water through oil cooler 16 and oil warmer 21 by giving priority to component protection than fuel economy at the vehicle start from the idle reduction state. Thus, when the oil temperatures are above their upper limit temperatures, control device 100 uses the target rotor angle of the all-path flow mode, i.e., the fifth or sixth mode, so as to open all the first to fourth cooling water lines.

In response, the cooling water starts to circulate through oil cooler 16 on the second cooling water line as well as oil warmer 21 on the fourth cooling water line. This reduces the oil temperatures of internal combustion engine 10 and transmission 20 below their upper limit temperatures, and allows achieving component protection. On the other hand, when the oil temperatures are equal to or below their upper limit temperatures, control device 100 uses the target rotor angle of the seventh mode. Thereby, control device 100 reduces the supply rates of the cooling water to the second and fourth cooling water lines as the oil temperatures decrease, so that the supply rates of the cooling water to the first and third cooling water lines are relatively increased.

As described above, during a decelerating state toward an idle reduction state in addition to during the idle reduction state, control device 100 performs the control according to the automatic stop mode in which the supply rates of the cooling water to the second and fourth cooling water lines is reduced so that the supply rates of the cooling water to the first and third cooling water lines are relatively increased. Thereby, control device 100 accelerates the temperature decrease of cylinder head 11 during idle reduction. This lowers the probability of knocking in internal combustion engine 10 at the restart from the idle reduction state, and allows control device 100 to advance ignition timing of internal combustion engine 10 as much as possible. Thus, the fuel economy of internal combustion engine 10 during acceleration when the vehicle is started from a vehicle stop is improved. It might be considered that, during a decelerating state toward an idle reduction state in addition to during the idle reduction state, control device 100 can increase the supply rate of the cooling water circulating through cylinder head 11 and then radiator 50 by increasing the discharge flow rate of electric water pump 40 while supplying the cooling water to the first to fourth cooling water lines. However, this causes electric water pump 40 to consume more electric power during idle reduction. Accordingly, the above method can accelerate the temperature decrease of cylinder head 11, but only at the expense of less improvement in fuel economy brought by idle reduction.

In contrast, stopping cooling water flow through the second and fourth cooling water lines allows an increase in the cooling water circulation rate through the first and third cooling water lines even without changing the discharge flow rate of electric water pump 40. Thus, electric power consumption by electric water pump 40 less reduces the improvement in fuel economy brought by the temperature decrease of cylinder head 11. Furthermore, during idle reduction, control device 100 increases the supply rate of the cooling water to the third cooling water line in addition to the first cooling water line. In other words, control device 100 increases the rate of the cooling water circulating through heater core 91 during idle reduction. This curbs the temperature decrease of air for air conditioning during idle reduction while the vehicle air heater is on. Thus, it is possible to curb the decrease in vehicle interior temperature and improve air heating performance during idle reduction.

After the temperature of cylinder head 11 has been reduced to the target temperature during idle reduction, heat is no longer generated in internal combustion engine 10. Accordingly, in this case, there is an option to stop the cooling water circulation through cylinder head 11. However, stopping such cooling water circulation causes variation in temperature within the cooling water circulation passage, and causes first temperature sensor 81 to no longer accurately measure the temperature of cylinder head 11. In light of the above, as illustrated in the flowchart of FIG. 6, when the temperature of cylinder head 11 has been reduced to the target temperature during idle reduction, control device 100 may set the target rotation speed of electric water pump 40 to a low rotation speed (low rotation speed>0 rpm) low enough to provide only the minimum circulation rate that sufficiently reduces such temperature variation.

Figure 6:
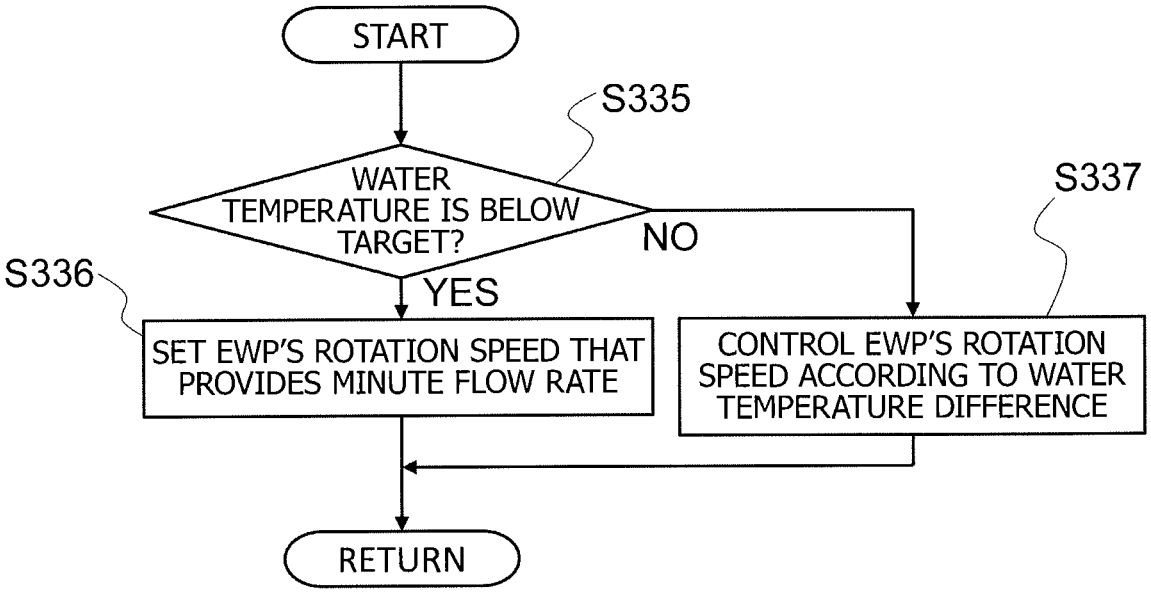
FIG. 6 is a flowchart illustrating control for setting the target rotation speed of the electric water pump after the water temperature has been reduced during idle reduction according to the embodiment of the present invention.

The flowchart of FIG. 6 illustrates an example of the details of the processing in step S330 in the flowchart of FIG. 3. In step S335, control device 100 compares the head outlet water temperature with the target temperature. When the head outlet water temperature is below the target temperature, the operation proceeds to step S336. In step S336, control device 100 sets the target rotation speed of electric water pump 40 to a rotation speed low enough to provide only the minimum circulation rate that sufficiently reduces variation in temperature within the cooling water circulation passage. As a result, electric water pump 40 operates at a minimal rotation speed.

On the other hand, when the head outlet water temperature is equal to or above the target temperature, the operation proceeds to step S337. In step S337, control device 100 fixes the target rotation speed of electric water pump 40 to the target value for cooling acceleration in the seventh mode, or varies the target rotation speed depending, for example, on the difference between the head outlet water temperature and the target temperature. Thereby, control device 100 accelerates the temperature decrease of cylinder head 11 and ensures the air heating performance. In other words, in step S337, control device 100 can set the target rotation speed in the same manner as in steps S332 and S333. The target rotation speed set in step S337, which is higher than the target rotation speed set in step S336, is high enough to provide a circulation rate that ensures acceleration of the temperature decrease of cylinder head 11.

As described above, when the head outlet water temperature falls below the target temperature, control device 100 controls the rotation speed of electric water pump 40 so as to provide only the minimum circulation rate that sufficiently reduces variation in temperature within the cooling water circulation system. In this way, during idle reduction, control device 100 reduces variation in temperature within the cooling water circulation system so as to maintain the measurement accuracy of the temperature of cylinder head 11 while limiting electric power consumption of electric water pump 40.

Furthermore, the above method more effectively suppresses the deterioration of the air heating performance than stopping the cooling water flow through heater core 91 during idle reduction. Here, after the temperature of cylinder head 11 has been reduced to the target temperature during idle reduction, the additional cooling water allocation to the first cooling water line for accelerating the temperature decrease of cylinder head 11 is no longer necessary. Thus, at that time, control device 100 is allowed to increase the cooling water circulation rate through the second and fourth cooling water lines.

Figure 7:
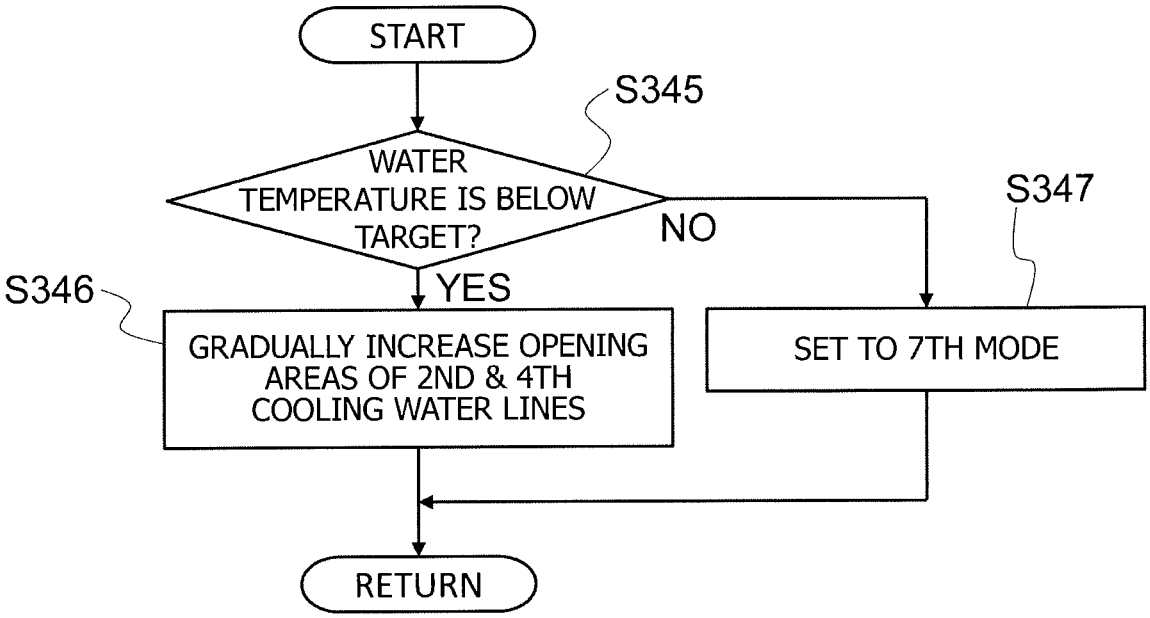
FIG. 7 is a flowchart illustrating control for resuming cooling water flow through the second and fourth cooling water lines in response to a decrease in the water temperature during idle reduction according to the embodiment of the present invention.

The flowchart of FIG. 7 illustrates an example of the details of the processing in step S340 in the flowchart of FIG. 3. In step S345, control device 100 compares the head outlet water temperature with the target temperature. When the head outlet water temperature is below the target temperature, the operation proceeds to step S346. In step S346, control device 100 cancels the stop of the cooling water flow through the second and fourth cooling water lines, and controls the rotor angle of flow rate control valve 30 within the angular range for the fifth or sixth mode so as to gradually increase the opening areas of the second and fourth cooling water lines.

As a result, the high-temperature cooling water having stayed in the second and fourth cooling water lines gradually flows out, and the cooling water temperatures in the second and fourth cooling water lines gradually decrease. Thus, the above control prevents the high-temperature cooling water having stayed in the second and fourth cooling water lines from flowing out all at once and boosting the temperature of the entire cooling system upon engine restart. On the other hand, when the head outlet water temperature is equal to or above the target temperature, the operation proceeds to step S347. In step S347, control device 100 may set the target rotor angle to an angle according to the seventh mode, which stops cooling water flow through the second and fourth cooling water lines. Alternatively, as in step S341 described above, control device 100 may perform processing for determining, based on the oil temperatures, whether to permit or prohibit cooling water flow through the second and fourth cooling water lines.

Figure 8:
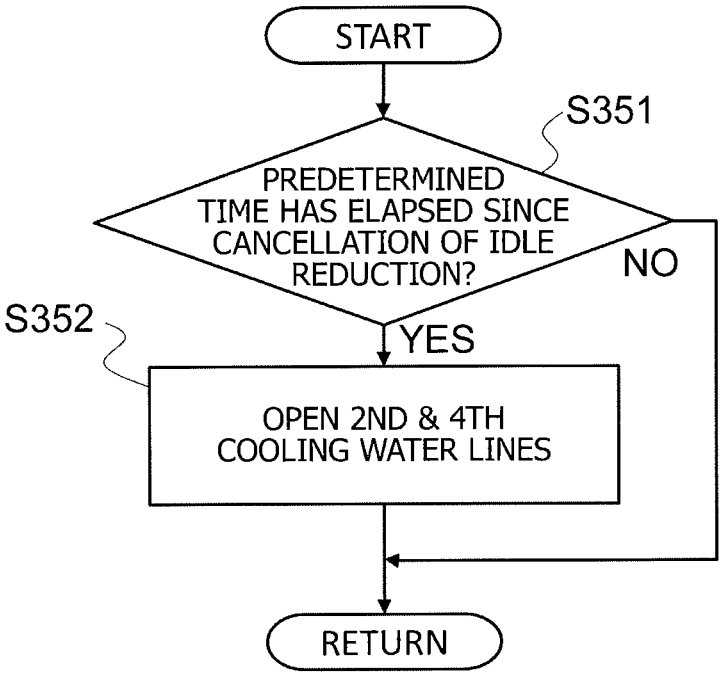
FIG. 8 is a flowchart illustrating control for resuming cooling water flow through the second and fourth cooling water lines after the cancellation of idle reduction according to the embodiment of the present invention.

Either when conditions for resuming the cooling water flow through the second and fourth cooling water lines are not satisfied during idle reduction or when the resumption of the cooling water flow through the second and fourth cooling water lines during idle reduction is prohibited, control device 100 may resume cooling water flow through the second and fourth cooling water lines after the cancellation of idle reduction as illustrated in the flowchart of FIG. 8. In the flowchart of FIG. 8, in step S351, control device 100 determines whether or not the amount of time elapsed since the operation of internal combustion engine 10 resumes in response to the cancellation of idle reduction has reached a predetermined time.

When control device 100 determines that the predetermined time has elapsed since the resumption of operation of internal combustion engine 10, the operation proceeds to step S352. In step S352, control device 100 cancels the processing for stopping cooling water flow through the second and fourth cooling water lines and switches, for example, to the fifth or sixth mode that allows the cooling water circulation through all the first to fourth cooling water lines. Thereby, the opening areas of the second and fourth cooling water lines are increased in a stepwise manner, thus permitting the outflow of the high-temperature cooling water having stayed in the second and fourth cooling water lines while the cooling water flow therethrough has been stopped. Here, this mode switching is performed after a sufficient amount of time has elapsed since the resumption of the operation of internal combustion engine 10, and thus its impact to the operation of internal combustion engine 10 is sufficiently curbed.

Figure 9:
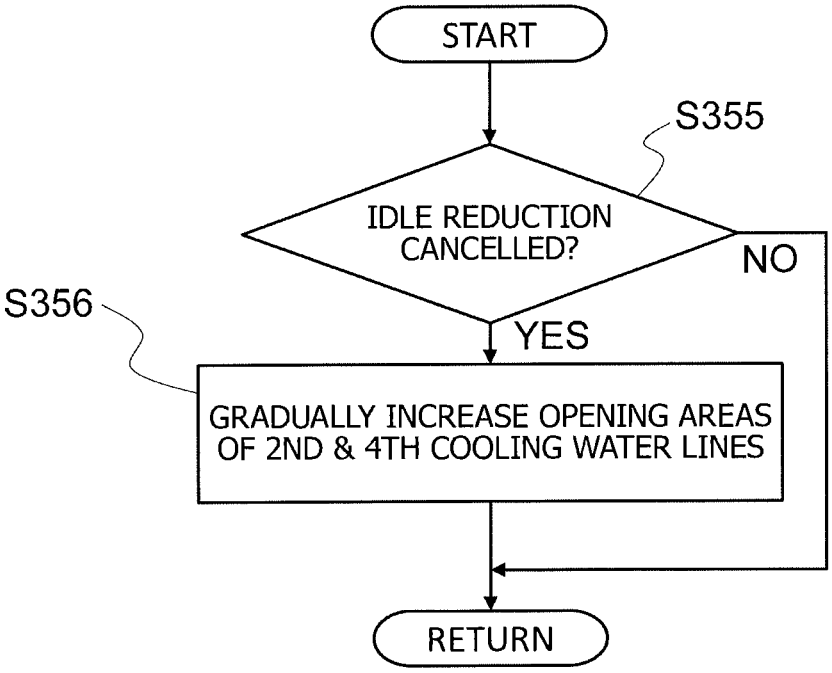
FIG. 9 is a flowchart illustrating another control for resuming cooling water flow through the second and fourth cooling water lines in response to the cancellation of idle reduction according to the embodiment of the present invention.

As alternative processing for resuming cooling water flow through the second and fourth cooling water lines after the resumption of the operation of internal combustion engine 10, control device 100 may perform processing illustrated in the flowchart of FIG. 9. In step S355, control device 100 determines whether or not the operation of internal combustion engine 10 has resumed in response to the cancellation of idle reduction.

When control device 100 determines that the operation of internal combustion engine 10 has resumed in response to the cancellation of idle reduction, the operation proceeds to step S356. In step S356, control device 100 cancels the stop of cooling water flow through the second and fourth cooling water lines, and controls the target rotor angle of flow rate control valve 30 so as to gradually increase the opening areas of the second and fourth cooling water lines. As a result, the high-temperature cooling water that stayed in the second and fourth cooling water lines during idle reduction gradually flows out. Thus, the above control prevents the high-temperature cooling water that stayed in the second and fourth cooling water lines from flowing out all at once and boosting the temperature of the entire cooling system upon the cancellation of idle reduction.

Figure 10:
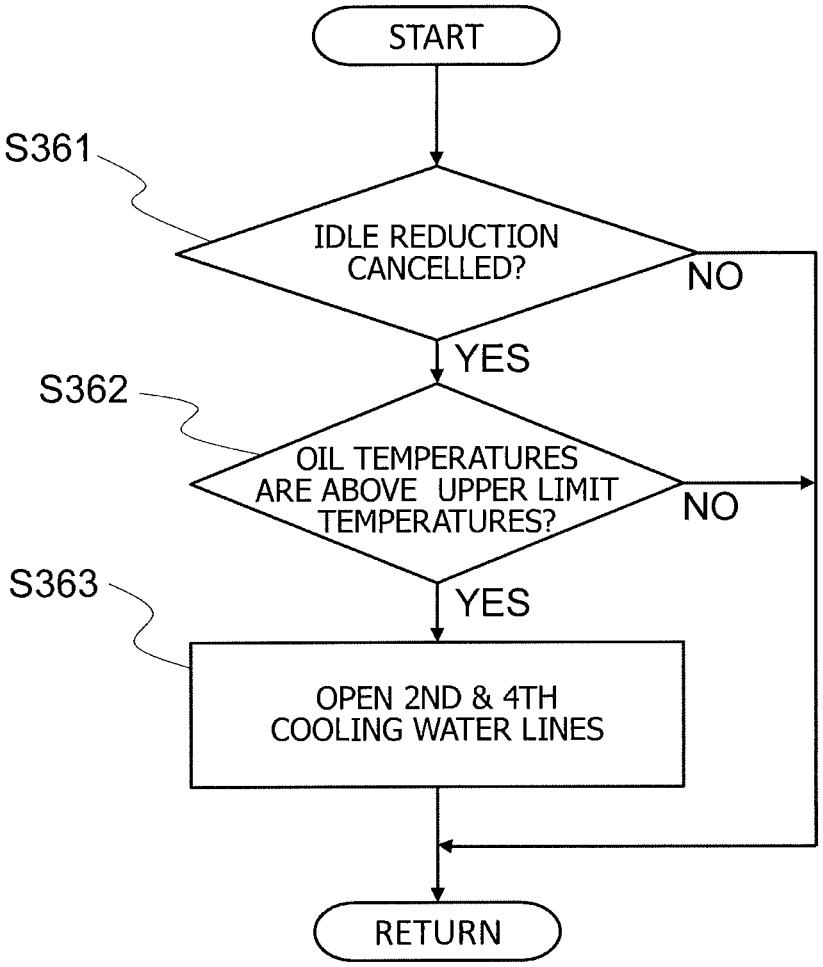
FIG. 10 is a flowchart illustrating control for resuming cooling water flow through the second and fourth cooling water lines based on the oil temperatures after the cancellation of idle reduction according to the embodiment of the present invention.

As alternative processing for resuming cooling water flow through the second and fourth cooling water lines after the resumption of the operation of internal combustion engine 10, control device 100 may perform processing illustrated in the flowchart of FIG. 10. In step S361, control device 100 determines whether or not the operation of internal combustion engine 10 has resumed in response to the cancellation of idle reduction.

When control device 100 determines that the operation of internal combustion engine 10 has resumed in response to the cancellation of idle reduction, the operation proceeds to step S362. In step S362, control device 100 determines whether or not the oil temperatures are above their upper limit temperatures. When control device 100 determines that the oil temperatures are below their upper limit temperatures, which indicates a low degree of need for circulating cooling water through oil cooler 16 and oil warmer 21, this routine ends immediately. Thereby, control device 100 continues to stop the cooling water flow through the second and fourth cooling water lines from during the previous idle reduction.

On the other hand, when control device 100 determines that the oil temperatures are above their upper limit temperatures, the operation proceeds to step S363. In step S363, control device 100 resumes cooling water flow through the second and fourth cooling water lines by increasing the opening areas of the second and fourth cooling water lines in a stepwise manner. This allows a rapid reduction of the cooling water temperatures in the second and fourth cooling water lines, i.e., the oil temperatures of internal combustion engine 10 and/or transmission 20, thus allowing protection of the components of internal combustion engine 10 and transmission 20.

Figure 11:
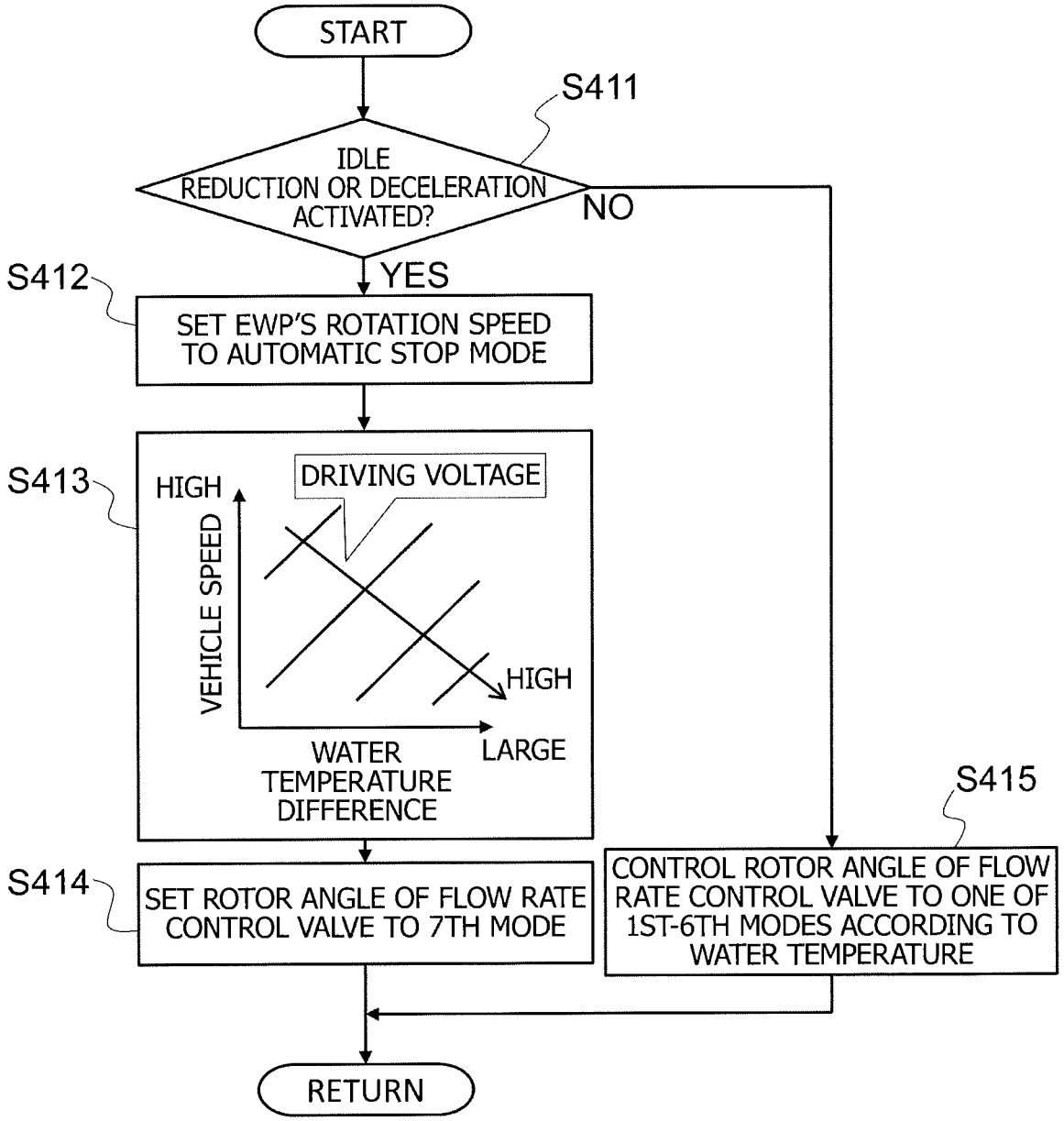
FIG. 11 is a flowchart illustrating the flow of controlling the flow rate control valve, electric water pump, and electric radiator fans according to the embodiment of the present invention.

In addition to the above control on flow rate control valve 30 and electric water pump 40, control device 100 may also drive electric radiator fans 50A, 50B in an operating state during a decelerating state of vehicle 26 and during idle reduction of internal combustion engine 10. This further accelerates the temperature decrease of cylinder head 11 during idle reduction. The flowchart of FIG. 11 illustrates an example of how electric radiator fans 50A, 50B are controlled by control device 100 according to the automatic stop mode.

When control device 100 determines that vehicle 26 is in a predetermined decelerating state or that internal combustion engine 10 is in the idle reduction state in step S411, the operation proceeds to step S412. In step S412, control device 100 sets the target rotation speed of electric water pump 40 to the target rotation speed for the automatic stop mode in the same manner as in step S330. After that, the operation proceeds to step S413 in which control device 100 controls electric radiator fans 50A, 50B according to the automatic stop mode.

In controlling electric radiator fans 50A, 50B according to the automatic stop mode, control device 100 sets the driving voltage of electric radiator fans 50A, 50B based on the vehicle speed and water temperature difference TWDC in the same manner as, for example, control device 100 sets the target pump rotation speed in step S333. Specifically, control device 100 sets the driving voltage of electric radiator fans 50A, 50B such that the lower the vehicle speed, the higher the driving voltage of electric radiator fans 50A, 50B, and such that the higher the head outlet water temperature above the target temperature for the idle reduction state, the higher the driving voltage of electric radiator fans 50A, 50B.

Then, the operation proceeds to step S414, in which control device 100 sets the target rotor angle of flow rate control valve 30 within the angular range of the seventh mode, which is adapted to the idle reduction state as in step S340. When vehicle 26 is not in the predetermined decelerating state, and internal combustion engine 10 is not in an idle reduction state, the operation proceeds to step S415. In step S415, control device 100 selects any one of the first to sixth modes in accordance with the measurement value of the water temperature, and controls electric water pump 40 and flow rate control valve 30 according to the selected mode as in step S320. In addition, control device 100 also controls the driving voltage of electric radiator fans 50A, 50B in accordance with the water temperature and the like in step S415.

Figure 12:
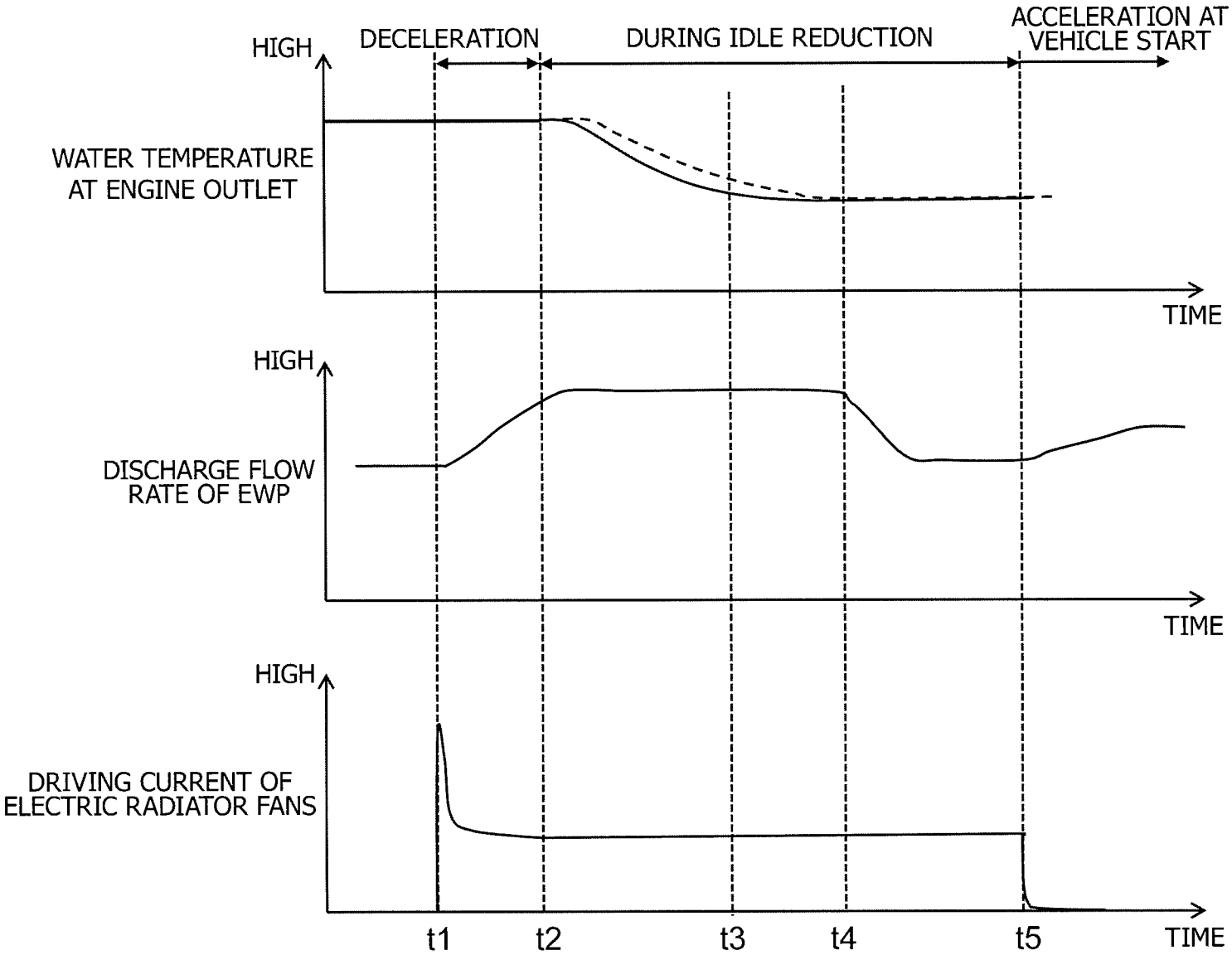
FIG. 12 is a time chart exemplifying changes in the water temperature when the discharge flow rate of the electric water pump is increased as early as when the vehicle is in a decelerating state, according to the embodiment of the present invention.

The target value of the head outlet water temperature which is employed when vehicle 26 is not in the predetermined decelerating state and internal combustion engine 10 is not in an idle reduction state is higher than that employed in the automatic stop mode. Consequently, in the automatic stop mode, electric radiator fans 50A, 50B are driven with a higher driving voltage. FIG. 12 is a time chart that exemplifies changes in the following variables while vehicle 26 is in the predetermined decelerating state and internal combustion engine 10 is in the idle reduction state: the discharge flow rate of electric water pump 40, the head outlet water temperature, and the driving current of electric radiator fans 50A, 50B.

In FIG. 12, vehicle 26 enters the predetermined decelerating state at time point t1. In response, the idle reduction mode is activated. As a result, the driving voltage of electric radiator fans 50A, 50B as well as the target rotation speed of electric water pump 40 are increased. This increases the driving current of electric radiator fans 50A, 50B and the discharge flow rate of electric water pump 40. Then, internal combustion engine 10 is automatically stopped by the idle reduction function at time point t2. In response, the head outlet water temperature starts to decrease, and is detected to reach a predetermined temperature at time point t4. In response, the discharge flow rate of electric water pump 40 is reduced.

Here, the processing for increasing the discharge flow rate of electric water pump 40 starts as early as the decelerating state. This more accelerates the temperature decrease of cylinder head 11 than when such increasing processing starts as late as when internal combustion engine 10 enters the idle reduction state. As a result, for example, the head outlet water temperature is reduced to a lower level at time point t3 when the processing for increasing the discharge flow rate of electric water pump 40 starts as early as the decelerating state. Similarly, electric radiator fans 50A, 50B start to be driven as early as the decelerating state, and electric radiator fans 50A, 50B are maintained in an operating state during idle reduction. This still further accelerates the decrease in head outlet water temperature.

Figure 13:
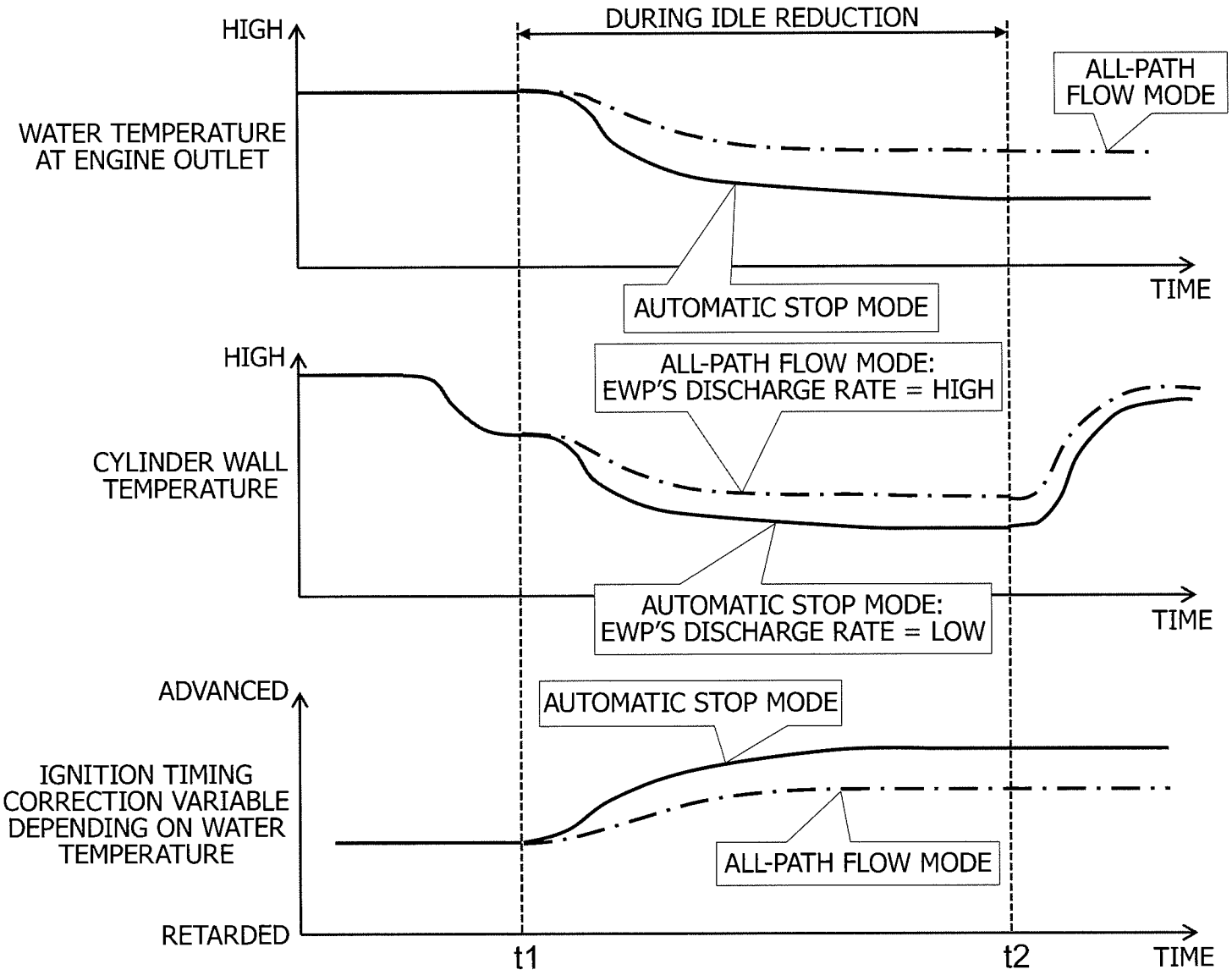
FIG. 13 is a time chart for exemplifying water temperature lowering characteristics during idle reduction according to the embodiment of the present invention.

FIG. 13 is a time chart for illustrating the effect of the processing for stopping cooling water flow through the second and fourth cooling water lines during idle reduction. Specifically, FIG. 13 exemplifies changes in the following variables during idle reduction: the head outlet water temperature, the cylinder wall temperature, and an ignition timing correction variable which varies depending on temperature conditions. Assume here that cooling water flow through all the first to fourth cooling water lines is permitted and electric water pump 40 is in an operating state even during idle reduction between time point t1 and time point t2. Even in such a case, it is possible to reduce the cylinder head temperature during idle reduction as illustrated in FIG. 13.

However, when cooling water flow through the second and fourth cooling water lines is prohibited while cooling water flow through the first and third cooling water lines is permitted during idle reduction, the temperature decrease that matches or surpasses that achieved by permitting cooling water flow through all the first to fourth cooling water lines can be achieved even with a reduced rotation speed of electric water pump 40. Furthermore, when control device 100 starts to control the rotor angle of flow rate control valve 30 according to the automatic stop mode as early as the decelerating state toward the idle reduction state, the decrease in the cylinder temperature is further accelerated.

Furthermore, when the temperature of cylinder head 11, i.e., the combustion chamber wall temperature is reduced during idle reduction, the probability of knocking is reduced and the ignition timing can be further advanced. Such ignition timing advance leads to an increase in the output torque, thus improving fuel economy during acceleration when the vehicle is started. Assume here that cooling water flow through the third cooling water line is stopped in addition to the stop of cooling water flow through the second and fourth cooling water lines. This will reduce the temperature of cylinder head 11 more efficiently, but in turn will deteriorate air heating performance during idle reduction, thus permitting a decrease in vehicle interior temperature during air heating because the cooling water flow through heater core 91 is stopped.

Figure 14:
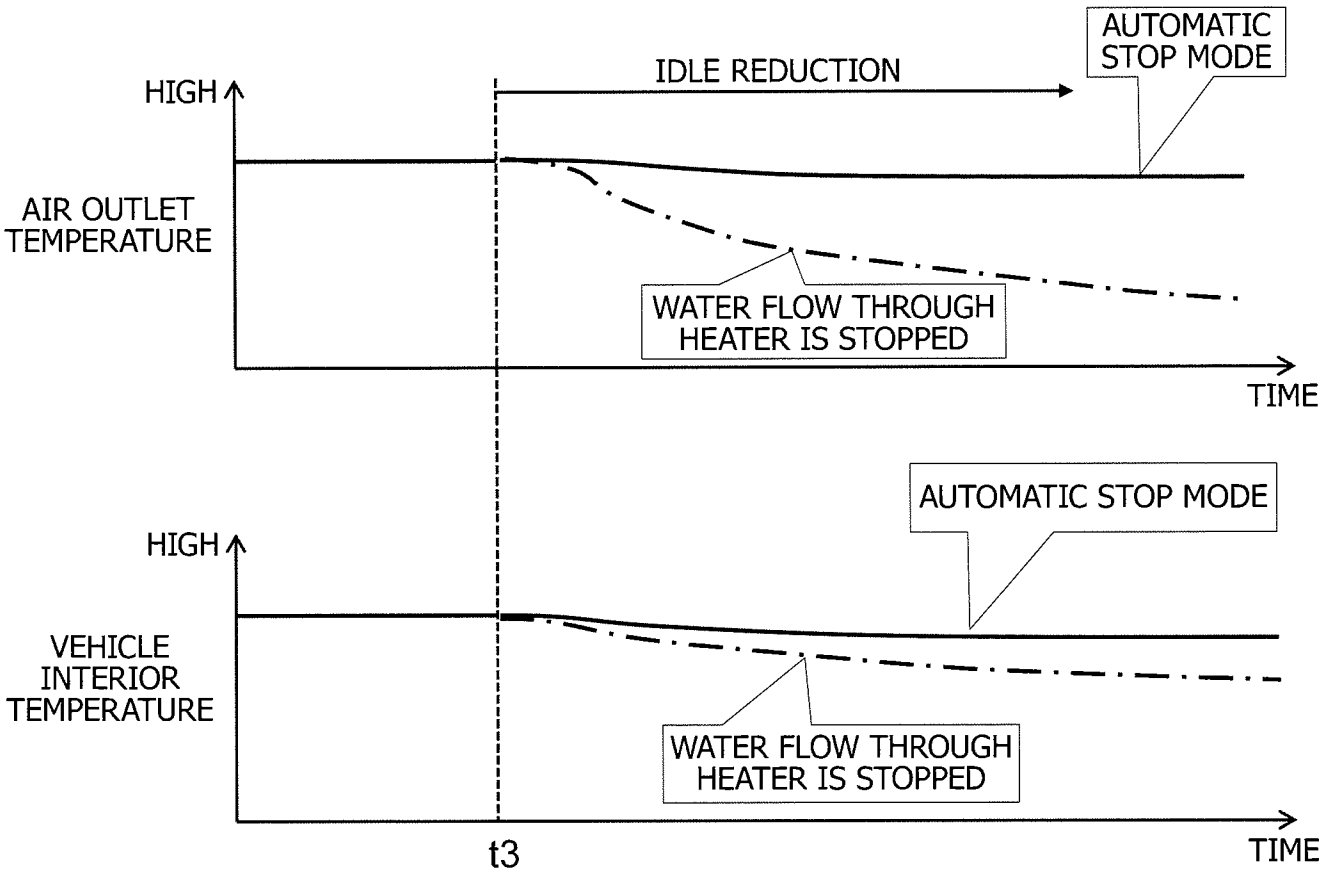
FIG. 14 is a time chart exemplifying the characteristics of the air heating performance during idle reduction according to the embodiment of the present invention.

FIG. 14 is a time chart illustrating an example of the correlation between the presence or absence of cooling water flow through heater core 91 and each of the air outlet temperature and vehicle interior temperature during idle reduction. As illustrated in FIG. 14, if cooling water flow through the third cooling water line is stopped during idle reduction, i.e., after time point t3, the temperature of air for air conditioning at the air outlet gradually decreases, so that the vehicle interior temperature decreases accordingly. In contrast, when electric water pump 40 is in an operating state and the cooling water flow through third cooling water line continues during idle reduction, the air temperature at the air outlet is maintained unchanged. Thus, the decrease in vehicle interior temperature is suppressed during idle reduction.

Figure 15:
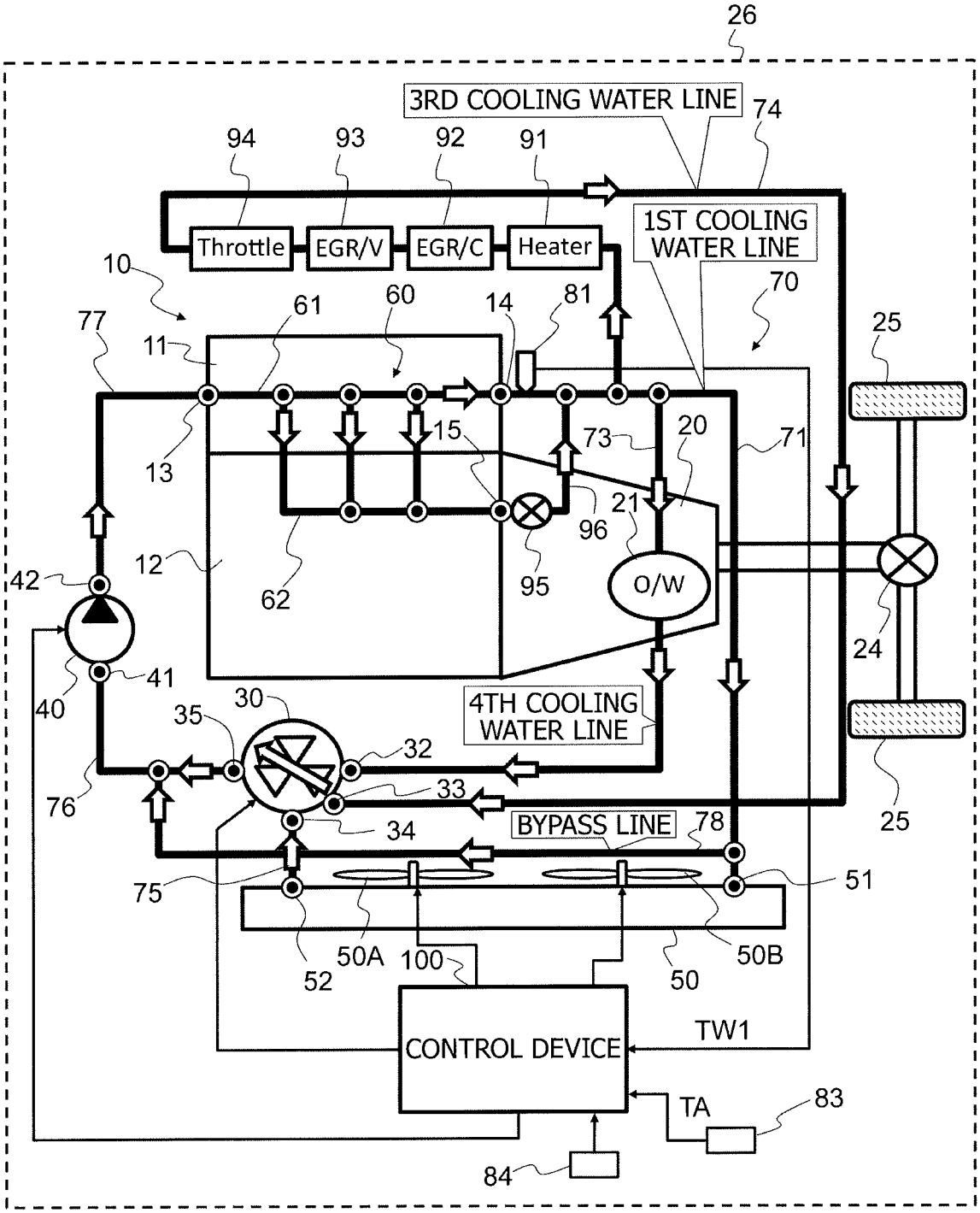
FIG. 15 is a schematic system view of the cooling device for an internal combustion engine according to an embodiment of the present invention.

According to the system configuration of FIG. 1, the cooling device includes the first to fourth cooling water lines, and controls the cooling water flow rates through the cooling water lines by adjusting flow rate control valve 30. However, it is obvious that the present invention is not limited to such a configuration. For example, an implementation of the cooling device illustrated in FIG. 15 is also possible according to the present invention. The implementation has a system configuration in which flow rate control valve 30 controls the flow rates through the first, third and fourth cooling water lines, and a thermostat 95 controls the cooling water flow rate through cylinder block cooling water passage 62. Note that the same reference numerals are given to the same components in the system configuration illustrated in FIG. 15 as those in FIG. 1, and detailed description of these components will be omitted.

In the system configuration of FIG. 15, thermostat 95 is disposed at the downstream end of cylinder block cooling water passage 62. Thermostat 95 opens or closes in response to the cooling water temperature. A ninth cooling water pipe 96 connects the outlet of thermostat 95 to first cooling water pipe 71, which is connected to the outlet of cylinder head cooling water passage 61. The junction of first cooling water pipe 71 and ninth cooling water pipe 96 is located upstream to the junction of fourth cooling water pipe 74 and first cooling water pipe 71.

Thus, thermostat 95 opens when the cooling water temperature in cylinder block cooling water passage 62 exceeds the valve opening temperature of thermostat 95. The open state of thermostat 95 allows the cooling water flowing through cylinder head cooling water passage 61 to be partially diverted into cylinder block cooling water passage 62. The cooling water having flowed through cylinder block cooling water passage 62 passes through thermostat 95, then flows through ninth cooling water pipe 96, and joins the cooling water flowing through first cooling water pipe 71.

The cooling water temperature to open thermostat 95 is set such that thermostat 95 is maintained closed in low and middle load operation states of internal combustion engine 10 and that thermostat 95 opens in a high load operation state of internal combustion engine 10. For example, the cooling water temperature to open thermostat 95 is set to approximately 90 to 95° C. In the system of FIG. 15, the cooling water within cylinder block cooling water passage 62 is not confined therein while thermostat 95 is closed. Rather, cylinder block cooling water passage 62 is communicated with cylinder head cooling water passage 61 by a plurality of parallel passages so as to allow the cooling water within cylinder block cooling water passage 62 to be replaced as a result, for example, of the cooling water temperature difference between cylinder head cooling water passage 61 and cylinder block cooling water passage 62 even while thermostat 95 is closed.

In the system configuration of FIG. 15, the first cooling water line, the third cooling water line, and the fourth cooling water line are provided in the same manner as in the system configuration of FIG. 1. Flow rate control valve 30 has three inlet ports 32 to 34 connected to the first, third and fourth cooling water lines, and adjusts the cooling water flow rates through these cooling water lines depending on the rotor angle.

Figure 16:
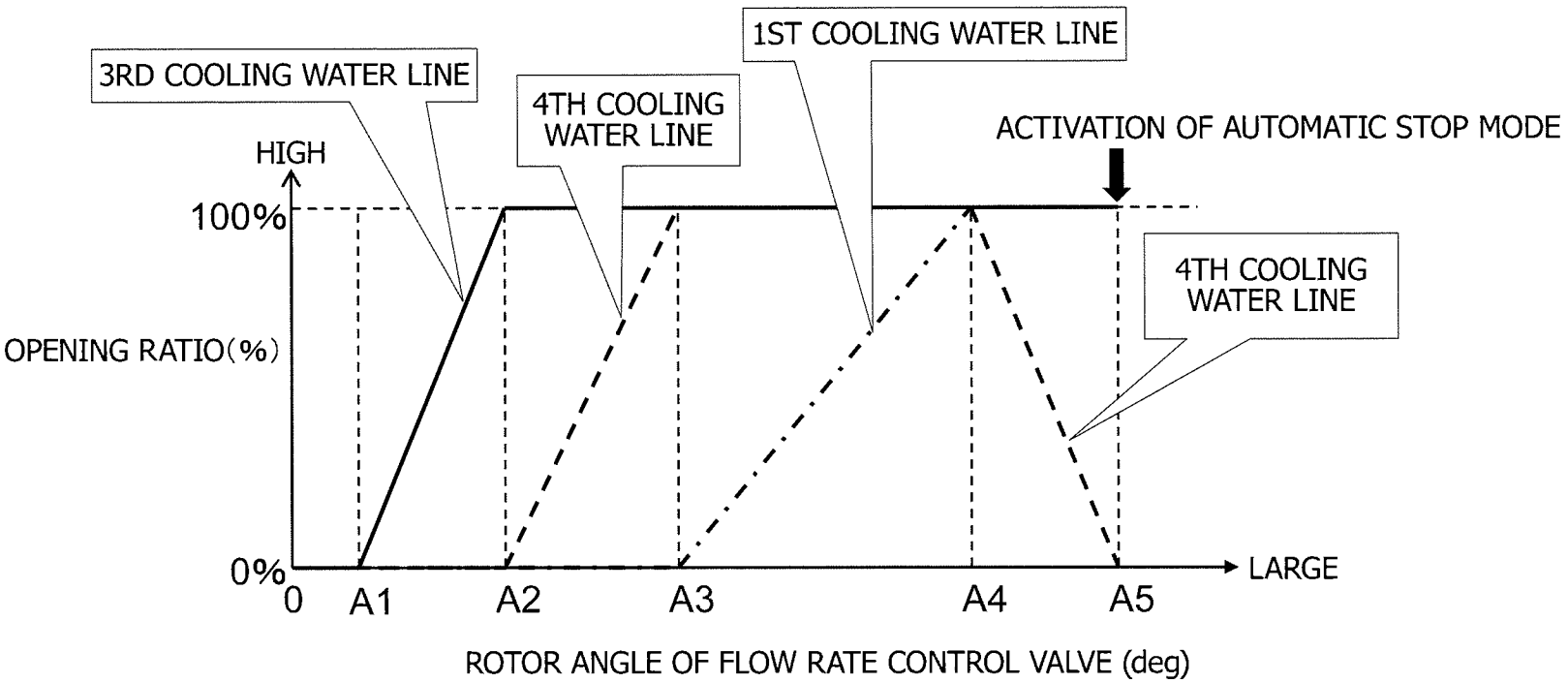
FIG. 16 is a graph for illustrating the correlation between the rotor angle and opening ratio of the flow rate control valve of FIG. 15.

FIG. 16 illustrates an example of the correlation between the rotor angle of flow rate control valve 30 and the opening ratio (%) of each of inlet ports 32 to 34 in the system configuration of FIG. 15. The term "opening ratio" herein refers to the ratio of the actual opening area to the full opening area of each of inlet ports 32 to 34. When the rotor angle of flow rate control valve 30 is equal to or below a first rotor angle A1, three inlet ports 32 to 34, which are connected to the first, third and fourth cooling water lines, are maintained fully closed, i.e., maintained such that opening ratio=0% holds.

Then, as the rotor angle of flow rate control valve 30 exceeds and increases above the first rotor angle A1, the opening ratio of inlet port 33, connected to the third cooling water line, gradually increases with inlet ports 32, 34, connected to the first and fourth cooling water lines, maintained fully closed. Inlet port 33 becomes fully opened, i.e., opening ratio=100%, when the rotor angle reaches a second rotor angle A2. As the rotor angle further increases from the angular position A2, at which the opening ratio of inlet port 33 reaches the maximum, the opening ratio of inlet port 32, connected to the fourth cooling water line, gradually increases. Inlet port 32 becomes fully opened when the rotor angle reaches a third rotor angle A3. Thus, at the third rotor angle A3, inlet ports 32, 33 are both fully opened and inlet port 34 is maintained fully closed.

As the rotor angle further increases above the third rotor angle A3, the opening ratio of inlet port 34, connected to the first cooling water line, gradually increases. Inlet port 34 becomes fully opened when the rotor angle reaches a fourth rotor angle A4. Thus, at the fourth rotor angle A4, all inlet ports 32 to 34 are fully opened. As the rotor angle further increases above the fourth rotor angle A4, the opening ratio of inlet port 32, connected to the fourth cooling water line, gradually decreases from the maximum. Inlet port 32 becomes fully closed again when the rotor angle becomes a fifth rotor angle A5. Thus, at the fifth rotor angle A5, inlet port 32 is fully closed and inlet ports 33, 34 are maintained fully opened.

Here, the rotor angle of flow rate control valve 30 is controlled based on the reference position, which corresponds to 0 degrees, where 0 degrees <first rotor angle A1<second rotor angle A2<third rotor angle A3<fourth rotor angle A4<fifth rotor angle A5. In other words, inlet port 33 increases its opening area along with an increase in the rotor angle from the first rotor angle A1 to the second rotor angle A2, and is maintained fully opened from the second rotor angle A2 to the fifth rotor angle A5.

Inlet port 32 is maintained fully closed from the first rotor angle A1 to the second rotor angle A2, then increases its opening area along with an increase in the rotor angle from the second rotor angle A2 to the third rotor angle A3, then is maintained fully opened from the third rotor angle A3 to the fourth rotor angle A4, then deceases its opening area along with an increase in the rotor angle form the fourth rotor angle A4 to the fifth rotor angle A5, and becomes fully closed again at the fifth rotor angle A5.

Inlet port 34 is maintained fully closed from the first rotor angle A1 to the third rotor angle A3, then increases its opening area along with an increase in the rotor angle from the third rotor angle A3 to the fourth rotor angle A4, and is maintained fully opened from the fourth rotor angle A4 to the fifth rotor angle A5. Note that, although FIG. 16 illustrates that the minimum opening ratio is 0% and the maximum opening ratio is 100%, the opening ratio of each inlet port of flow rate control valve 30 may be controlled within the range of 0%<opening ratio <100%, 0%≤opening ratio<100% or 0%<opening ratio≤100%.

Figure 17:
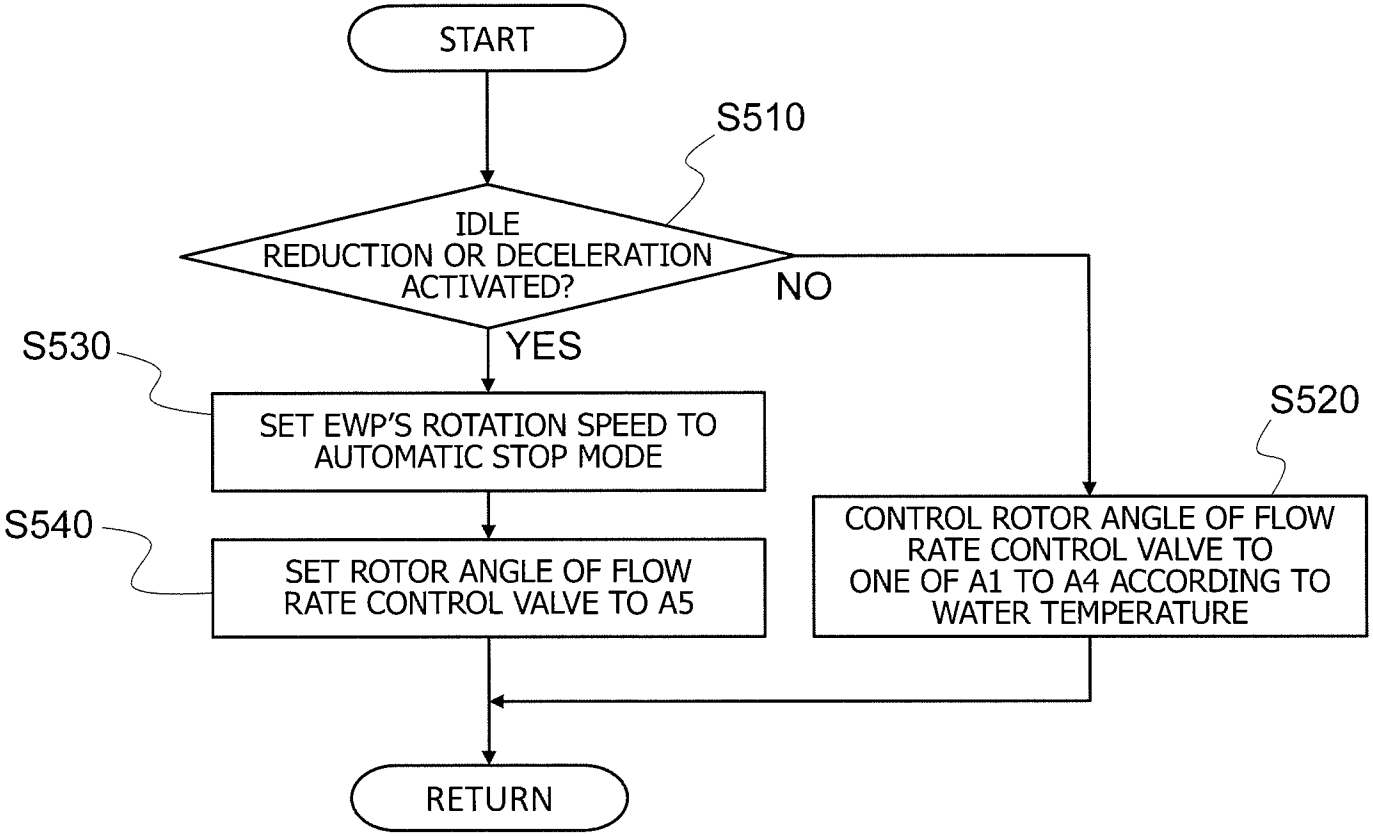
FIG. 17 is a flowchart illustrating the flow of controlling the flow rate control valve in the system configuration of FIG. 15.

Temperature sensor 81 for measuring the head outlet water temperature is disposed at the outlet of cylinder head cooling water passage 61. In the cooling device having the above configuration, control device 100 controls the rotor angle of flow rate control valve 30, i.e., the cooling water flow rates through the first, third and fourth cooling water lines, and controls the rotation speed of electric water pump 40, in accordance with the flowchart of FIG. 17.

In step S510, first, control device 100 determines whether or not vehicle 26 is in the predetermined decelerating state, or whether or not internal combustion engine 10 is in an idle reduction state, as in step S310. When vehicle 26 is not in the predetermined decelerating state, and internal combustion engine 10 is not in the idle reduction state, the operation proceeds to step S520. In step S520, control device 100 controls the rotor angle of flow rate control valve 30 within the angular range from the first rotor angle A1 to the fourth rotor angle A4 in accordance, for example, with the head outlet water temperature measured by temperature sensor 81.

Specifically, in step S520, the rotor angle of flow rate control valve 30 is controlled in the same manner as in step S320 of the flowchart of FIG. 3. In other words, control device 100 increases the rotor angle of flow rate control valve 30 along with the progression of the warm-up of internal combustion engine 10, and sets the rotor angle to the fourth rotor angle A4 so as to fully open the first, third and fourth cooling water lines during a high load operation state in which the water temperature at the head outlet exceeds the target temperature.

In addition, control device 100 controls the rotation speed of electric water pump 40 in parallel to the control of the rotor angle of flow rate control valve 30 described above. In other words, during engine warm-up, control device 100 accelerates the warm-up by limiting the rotation speed of electric water pump 40 to a low level. After the completion of the engine warm-up, control device 100 increases the rotation speed of electric water pump 40 as compared to during engine warm-up. In particular, when internal combustion engine 10 operates at such a high load that the rotor angle is set to the fourth rotor angle A4, control device 100 further increases the rotation speed of electric water pump 40 so as to maintain the cooling performance at a sufficient level.

On the other hand, when control device 100 determines that vehicle 26 is in the predetermined decelerating state, the operation proceeds to step S530. Also, when control device 100 determines that internal combustion engine 10 is in an idle reduction state, the operation proceeds to step S530. In other words, control device 100 performs the cooling control according to the automatic stop mode also during a decelerating state toward an idle reduction state as well as during the idle reduction state. This further accelerates the temperature decrease of cylinder head 11 during the subsequent idle reduction. In step S530, control device 100 sets the target rotation speed of electric water pump 40 to the target rotation speed for the automatic stop mode, as in step S330.

Then, the operation proceeds to step S540, in which control device 100 sets the target rotor angle of flow rate control valve 30 to the fifth rotor angle A5 so as to fully open the first and third cooling water lines and fully close the fourth cooling water line. Alternatively, in step S540, control device 100 may set the target rotor angle of flow rate control valve 30 to a different target rotor angle preset for the automatic stop state that satisfies: fourth rotor angle A4<target rotor angle preset for the automatic stop state<fifth rotor angle A5.

In other words, as early as the decelerating state toward the idle reduction state, control device 100 starts to control the rotor angle of flow rate control valve 30 toward the fifth rotor angle A5, which corresponds to the automatic stop mode. Furthermore, during the subsequent idle reduction, control device 100 maintains the rotor angle within the angular range of the automatic stop mode. Within the angular range of the automatic stop mode, the supply rate of the cooling water to the second path, which extends through oil warmer 21 and bypasses radiator 50, is reduced while the supply rate of the cooling water to the first path, which includes cylinder head cooling water passage 61 and extends through radiator 50 or heater core 91, which are located downstream to cylinder head cooling water passage 61, is increased.

Thus, the cooling water flow control according to the automatic stop mode allows more efficient cooling of cylinder head 11 than when the cooling water flows through all the first, third, and fourth cooling water lines, thus accelerating the temperature decrease of cylinder head 11 during idle reduction. Furthermore, the cooling water flow control according to the automatic stop mode starts as early as the decelerating state toward the idle reduction state. This further accelerates the temperature decrease of cylinder head 11 during idle reduction. Here, in the control according to the automatic stop mode, control device 100 may maintain the target rotor angle of flow rate control valve 30 within the angular range of the automatic stop mode. However, control device 100 does not have to maintain the target rotor angle within the automatic stop mode. Control device 100 may switch between the modes in accordance with the need for oil cooling or the like.

Although the invention has been described in detail with reference to the preferred embodiment, it is apparent that the invention may be modified in various forms by one skilled in the art based on the fundamental technical concept and teachings of the invention. In the above embodiments, cooling water flow through heater core 91 is permitted throughout the automatic stop mode. Alternatively, however, cooling water flow through heater core 91 may be permitted in the automatic stop mode only when the air conditioner is in heating operation.

In the seventh mode of flow rate control valve 30, only the cooling water flow through the first cooling water line may be permitted while cooling water flow through the second to fourth cooling water lines is stopped. Furthermore, the present invention may also be applied to a cooling device which does not include first to fourth cooling water lines, but includes a line bypassing radiator 50 and a thermostat for controlling the opening area of this bypass line in accordance with the cooling water temperature. Even in such a case, the cooling device is capable of accelerating the temperature decrease of internal combustion engine 10 during idle reduction by increasing the discharge flow rate of an electric water pump for circulating cooling water as early as the decelerating state, and maintaining the electric water pump in an operating state during the idle reduction.

The driving voltage of electric radiator fans 50A, 50B during the decelerating state may vary depending on the external air temperature, operational conditions of internal combustion engine 10 before deceleration, and/or the like. Furthermore, the configuration of the cooling water circulation paths and the flow rate control valve that allow increasing the cooling water circulation rate through cylinder head cooling water passage 61, heater core 91, and radiator 50 while reducing the cooling water circulation rate through oil cooler 16 and oil warmer 21 is not limited to that illustrated in FIG. 1. For example, a plurality of flow rate control valves may be used to switch between the cooling water circulation paths.

Another alternative configuration may be employed which includes a cooling device in which the fourth cooling water line is omitted among the first to fourth cooling water lines illustrated in FIG. 1. Furthermore, in the cooling water circulation path illustrated in FIG. 1, the cooling water having entered cylinder head 11 is partially diverted into cylinder block 12. Alternatively, however, the cooling water may be diverted at a point upstream to cylinder head 11 so as to be introduced individually to cylinder head 11 and cylinder block 12.

The third cooling water line illustrated in FIG. 1 extends through heater core 91, EGR cooler 92, EGR control valve 93, and throttle valve 94. However, the third cooling water line has only to extend through at least heater core 91, and is not limited to one extending through all of heater core 91, EGR cooler 92, EGR control valve 93, and throttle valve 94. Furthermore, in the configuration illustrated in FIG. 1, oil warmer 21 for transmission 20 is disposed on the fourth cooling water line as a heat exchanger for the powertrain. Alternatively, however, another oil cooler for the transmission being separate from oil warmer 21 may be additionally disposed on the fourth cooling water line.

Furthermore, as an additional water pump for circulating the cooling water, a mechanical water pump driven by internal combustion engine 10 may be provided in addition to electric water pump 40. In such a configuration, the cooling water is circulated either by the mechanical water pump alone or by both the mechanical water pump and electric water pump 40 while internal combustion engine 10 is in an operating state, and the cooling water is circulated by electric water pump 40 during idle reduction. Furthermore, flow rate control valve 30 is not limited to a rotor type. For example, a flow rate control valve having a structure that includes a valve element configured to be linearly moved by an electric actuator may alternatively be used.

Here, technical concepts which can be grasped from the above embodiments will be disclosed below.

According to an aspect a cooling device for an internal combustion engine of a vehicle, the cooling device comprises: a cooling water circulation passage; an electric water pump for circulating cooling water through the cooling water circulation passage; and control means for increasing a discharge flow rate of the electric water pump while the vehicle is in a decelerating state, and for maintaining the electric water pump in an operating state while the internal combustion engine is in an automatic stop state which is assumed when the vehicle stops after the decelerating state.

In a preferred aspect of the cooling device for the internal combustion engine of the vehicle, during the decelerating state and the automatic stop state, the control means increases the discharge flow rate of the electric water pump, when a temperature of the cooling water is higher.

In another preferred aspect, the cooling water circulation passage has a plurality of paths including: a first path which extends through a cooling water passage in the internal combustion engine and through a radiator; and a second path which extends through the cooling water passage in the internal combustion engine and through a heat exchanger for a powertrain of the internal combustion engine, and bypasses the radiator, and the cooling device further comprises switching means for switching between a plurality of modes including: an all-path flow mode for allowing the cooling water to flow through all the plurality of paths; and an automatic stop mode for reducing a flow rate of the cooling water through the second path while increasing a flow rate of the cooling water through the first path. The control means causes the switching means to switch to the automatic stop mode during the decelerating state and the automatic stop state.

In yet another preferred aspect, the cooling water circulation passage includes: a radiator line which extends through a cylinder head cooling water passage in the internal combustion engine and through the radiator, and bypasses a cylinder block cooling water passage in the internal combustion engine; a heater line which extends through the cylinder head cooling water passage and through the heater core, and bypasses the radiator; and a powertrain system line which extends through the cylinder head cooling water passage and through the heat exchanger for the powertrain, and bypasses the radiator. The switching means opens the radiator line, the heater line, and the powertrain system line during the all-path flow mode, reduces an opening area of the powertrain system line during the automatic stop mode as compared to during the all-path flow mode.

In yet another preferred aspect, the cooling water circulation passage further includes, in addition to the radiator line, the heater line, and the powertrain system line: a block line extending through the cylinder block cooling water passage, which branches off from the cylinder head cooling water passage, and through a heat exchanger for cooling oil of the internal combustion engine so as to guide the cooling water to join a flow toward an outlet of the cylinder head cooling water passage. The block line is opened and closed by a thermostat.

In yet another preferred aspect, the cooling water circulation passage extends through a radiator including an electric radiator fan, and the control means causes the electric radiator fan to operate during the decelerating state and the automatic stop state.

In yet another preferred aspect, during the decelerating state, the control means increases a driving voltage of the electric radiator fan when a temperature of the cooling water is higher and when a vehicle speed is lower.

According to an aspect of a method for controlling a cooling device for an internal combustion engine of a vehicle, the cooling device includes: a cooling water circulation passage; and an electric water pump for circulating cooling water through the cooling water circulation passage; the control method comprising the steps of: detecting a decelerating state of the vehicle; increasing a discharge flow rate of the electric water pump upon detecting the decelerating state of the vehicle; detecting an automatic stop state of the internal combustion engine which is assumed when the vehicle stops after the decelerating state; and maintaining the electric water pump in an operating state during the automatic stop state.

In a preferred aspect of the method for controlling the cooling device for the internal combustion engine of the vehicle, the cooling water circulation passage has a plurality of paths including: a first path which extends through a cooling water passage in the internal combustion engine and through a radiator; and a second path which extends through the cooling water passage in the internal combustion engine and through a heat exchanger for a powertrain of the internal combustion engine, and bypasses the radiator, and the cooling device further includes switching means for switching between a plurality of modes including: an all-path flow mode for allowing the cooling water to flow through all the plurality of paths; and an automatic stop mode for reducing a flow rate of the cooling water through the second path while increasing a flow rate of the cooling water through the first path. The control method further comprises the steps of: causing the switching means to switch to the automatic stop mode upon detecting the decelerating state of the vehicle; and causing the switching means to switch to the automatic stop mode during the automatic stop state.

REFERENCE SYMBOL LIST

10 internal combustion engine
11 cylinder head
12 cylinder block
16 oil cooler (heat exchanger)
20 transmission (powertrain)
21 oil warmer (heat exchanger)
30 flow rate control valve (switching means)
31-34 inlet port
35 outlet port
40 electric water pump
50 radiator
61 cylinder head cooling water passage
62 cylinder block cooling water passage
71 first cooling water pipe
72 second cooling water pipe
73 third cooling water pipe
74 fourth cooling water pipe
75 fifth cooling water pipe
76 sixth cooling water pipe
77 seventh cooling water pipe
78 eighth cooling water pipe
81 first temperature sensor
82 second temperature sensor
91 heater core
92 EGR cooler
93 EGR control valve
94 throttle valve
95 thermostat
100 control device (control means)

The invention claimed is:

1. A cooling device for an internal combustion engine of a vehicle, comprising:

a cooling water circulation passage including:

a first cooling water line which extends through a cylinder head of the internal combustion engine and through a radiator, and configured such that water flows in the first cooling water line outside of a cylinder block of the internal combustion engine;

a second cooling water line which extends through the cylinder block, and configured such that water flows in the second cooling water line outside of the radiator;

a third cooling water line which extends through the cylinder head and a heater core, and bypasses the cylinder block and the radiator; and a fourth cooling water line which extends through the cylinder head and a heat exchanger for a powertrain of the internal combustion engine;

an electric water pump configured to circulate cooling water through the cooling water circulation passage;

a flow rate control valve configured to switch between a plurality of modes including an all-path flow mode to open each of the first cooling water line, the second cooling water line, the third cooling water line, and the fourth cooling water line; and an automatic stop mode to reduce opening areas of the second and fourth cooling water lines as compared to in the all-path flow mode; and a microcomputer configured to increase a discharge flow rate of the electric water pump when the vehicle is in a decelerating state as compared to a discharge flow rate before the vehicle is in the decelerating state while the cooling water is circulated through the cooling water circulation passage by the electric water pump, and maintain the electric water pump in an operating state while the internal combustion engine is in an automatic stop state which is assumed when the vehicle stops after the decelerating state; and cause the flow rate control valve to switch to the automatic stop mode during the decelerating state and the automatic stop state.

2. The cooling device for the internal combustion engine of the vehicle according to claim 1, wherein the cooling water circulation passage extends through the radiator, which includes an electric radiator fan, and wherein the microcomputer is further configured to control the electric radiator fan to operate during the decelerating state and the automatic stop state.

3. The cooling device for the internal combustion engine of the vehicle according to claim 2, wherein, during the decelerating state, the microcomputer is configured to cause a driving voltage of the electric radiator fan to increase when a temperature of the cooling water is higher and when a vehicle speed is lower.

4. A control device for use in a cooling device for an internal combustion engine of a vehicle, the cooling device including:

a cooling water circulation passage including:

a first cooling water line which extends through a cylinder head of the internal combustion engine and through a radiator, and configured such that water flows in the first cooling water line outside of a cylinder block of the internal combustion engine;

a second cooling water line which extends through the cylinder block, and configured such that water flows in the second cooling water line outside of the radiator;

a third cooling water line which extends through the cylinder head and a heater core, and bypasses the cylinder block and the radiator; and a fourth cooling water line which extends through the cylinder head and a heat exchanger for a powertrain of the internal combustion engine;

an electric water pump configured to circulate cooling water through the cooling water circulation passage; and a flow rate control valve configured to switch between a plurality of modes including an all-path flow mode to open each of the first cooling water line, the second cooling water line, the third cooling water line, and the fourth cooling water line; and an automatic stop mode to reduce opening areas of the second and fourth cooling water lines as compared to in the all-path flow mode, the control device comprising:

a microcomputer configured to increase a discharge flow rate of the electric water pump when the vehicle is in a decelerating state as compared to a discharge flow rate before the vehicle is in the decelerating state while the cooling water is circulated through the cooling water circulation passage by the electric water pump, and maintain the electric water pump in an operating state while the internal combustion engine is in an automatic stop state which is assumed when the vehicle stops after the decelerating state; and cause the flow rate control valve to switch to the automatic stop mode during the decelerating state and the automatic stop state.

5. A method for controlling a cooling device for an internal combustion engine of a vehicle, the cooling device including:

a cooling water circulation passage including:

a first cooling water line which extends through a cylinder head of the internal combustion engine and through a radiator, and configured such that water flows in the first cooling water line outside of a cylinder block of the internal combustion engine;

a second cooling water line which extends through the cylinder block, and configured such that water flows in the second cooling water line outside of the radiator;

a third cooling water line which extends through the cylinder head and a heater core, and bypasses the cylinder block and the radiator; and a fourth cooling water line which extends through the cylinder head and a heat exchanger for a powertrain of the internal combustion engine;

an electric water pump for circulating cooling water through the cooling water circulation passage; and a flow rate control valve configured to switch between a plurality of modes including an all-path flow mode to open each of the first cooling water line, the second cooling water line, the third cooling water line and the fourth cooling water line; and an automatic stop mode to reduce opening areas of the second and fourth cooling water lines as compared to in the all-path flow mode, the control method comprising:

detecting a decelerating state of the vehicle;

increasing a discharge flow rate of the electric water pump when the decelerating state of the vehicle is detected, as compared to a discharge flow rate before the vehicle is in the decelerating state while the cooling water is circulated through the cooling water circulation passage by the electric water pump;

detecting an automatic stop state of the internal combustion engine which is assumed when the vehicle stops after the decelerating state;

maintaining the electric water pump in an operating state during the automatic stop state;

causing the flow rate control valve to switch to the automatic stop mode upon detecting the decelerating state of the vehicle; and causing the flow rate control valve to switch to the automatic stop mode during the automatic stop state.

* * * * *